US009495942B2

(12) United States Patent
Vochezer

(10) Patent No.: US 9,495,942 B2
(45) Date of Patent: Nov. 15, 2016

(54) SHOULDER SUPPORT FOR A MUSICAL INSTRUMENT

(71) Applicant: Wittner GmbH & Co. KG, Isny (DE)

(72) Inventor: Georg Vochezer, Argenbuehl-Christazhofen (DE)

(73) Assignee: Wittner GmbH & Co. KG, Isny (DE)

( * ) Notice: Subject to any disclaimer, the term of this patent is extended or adjusted under 35 U.S.C. 154(b) by 146 days.

(21) Appl. No.: 14/303,085

(22) Filed: Jun. 12, 2014

(65) Prior Publication Data

US 2014/0290460 A1 Oct. 2, 2014

Related U.S. Application Data

(63) Continuation of application No. PCT/EP2012/054990, filed on Mar. 21, 2012, which is a continuation-in-part of application No. PCT/EP2011/072767, filed on Dec. 14, 2011.

(51) Int. Cl.
*G10D 1/02* (2006.01)
*G10D 3/18* (2006.01)

(52) U.S. Cl.
CPC ..... *G10D 3/18* (2013.01)

(58) Field of Classification Search
USPC ..... 84/280
See application file for complete search history.

(56) References Cited

U.S. PATENT DOCUMENTS

| | | | |
|---|---|---|---|
| 744,673 | A | 11/1903 | Balsley |
| 932,844 | A | 8/1909 | Beisheim |
| 1,156,925 | A | 10/1915 | Poehland |
| 1,416,644 | A | 5/1922 | Jordan |
| 1,756,676 | A | 4/1930 | Colbentson |
| 1,971,552 | A | 8/1934 | Fisher |
| 2,064,925 | A | 12/1936 | Kolitsch |
| 2,110,023 | A | 3/1938 | McGowan |
| 2,208,824 | A | 7/1940 | Weinberg |
| 2,248,854 | A | 7/1941 | Coffeen et al. |
| 2,483,052 | A | 9/1949 | Humphrey |
| 2,489,101 | A | 11/1949 | Mills |
| 2,746,336 | A | 5/1956 | Bisharat |
| 3,631,754 | A | 1/1972 | Kun |
| 3,690,211 | A | 9/1972 | Long |
| 3,728,928 | A | 4/1973 | Looser et al. |
| 3,896,694 | A | 7/1975 | Goldner |
| 3,912,355 | A | 10/1975 | Curado et al. |
| 4,029,953 | A | 6/1977 | Natoli |
| 4,084,477 | A | 4/1978 | Dominguez |
| 4,212,222 | A | 7/1980 | Henkle |

(Continued)

FOREIGN PATENT DOCUMENTS

| | | |
|---|---|---|
| CA | 2 419 912 | 8/2004 |
| CH | 277 350 | 8/1951 |

(Continued)

*Primary Examiner* — Christopher Uhlir
(74) *Attorney, Agent, or Firm* — Womble Carlyle Sandridge & Rice LLP

(57) ABSTRACT

A shoulder support for a musical instrument is proposed, which includes a holding device, by means of which the shoulder support is fixable or fixed to the musical instrument, at least one arm, which is fixable or fixed to the holding device, and a shoulder abutment element, which is fixable or fixed on the at least one arm and has a pad and a pad holder, the pad holder being movably held on an arm connecting part of the shoulder abutment element by means of a pad holder joint device.

40 Claims, 20 Drawing Sheets

(56) References Cited

U.S. PATENT DOCUMENTS

| | | | | |
|---|---|---|---|---|
| 4,373,771 | A | 2/1983 | Cross et al. | |
| 4,477,864 | A | 10/1984 | Van Duyn et al. | |
| 4,884,487 | A | 12/1989 | Feldkamp | |
| 5,166,527 | A | 11/1992 | Solymar | |
| 5,208,409 | A * | 5/1993 | Roulet | G10D 3/18 84/278 |
| 5,270,474 | A | 12/1993 | Kun | |
| 5,341,714 | A * | 8/1994 | Roulet | G10D 3/18 84/278 |
| 5,419,226 | A | 5/1995 | Kun | |
| 5,513,622 | A | 5/1996 | Musacchia, Sr. | |
| 5,897,391 | A | 4/1999 | Takahashi et al. | |
| 6,031,163 | A | 2/2000 | Cullum et al. | |
| 6,109,960 | A | 8/2000 | Cooper et al. | |
| 6,126,359 | A | 10/2000 | Dittrich et al. | |
| 6,268,555 | B1 | 7/2001 | Vochezer | |
| 6,291,750 | B1 | 9/2001 | Farha | |
| 6,369,303 | B1 * | 4/2002 | Hvezda | G10D 3/18 84/278 |
| 6,667,430 | B1 | 12/2003 | Liao | |
| 6,670,533 | B1 | 12/2003 | Yeh | |
| 6,680,431 | B2 | 1/2004 | Vanden et al. | |
| 6,927,328 | B2 | 8/2005 | Anderson | |
| 7,064,258 | B2 | 6/2006 | Mea | |
| 7,265,284 | B2 * | 9/2007 | Muir | G10D 3/18 84/279 |
| 7,368,645 | B2 * | 5/2008 | Armstrong | G10D 3/18 84/278 |
| 7,659,463 | B2 | 2/2010 | Twu | |
| 7,682,039 | B2 | 3/2010 | Kuo et al. | |
| 7,712,189 | B2 | 5/2010 | Francisco et al. | |
| 7,762,903 | B2 | 7/2010 | Bernhardt | |
| 7,857,523 | B2 | 12/2010 | Masuzaki | |
| 7,963,500 | B1 | 6/2011 | Holiday | |
| 7,980,781 | B2 | 7/2011 | Trice | |
| 8,002,491 | B2 | 8/2011 | Whitling et al. | |
| 8,040,032 | B2 | 10/2011 | Kovacs | |
| 8,550,843 | B2 | 10/2013 | Van Swearingen | |
| 2004/0011182 | A1 | 1/2004 | Ruan | |
| 2005/0126353 | A1 | 6/2005 | Trautmann | |
| 2006/0174743 | A1 | 8/2006 | Clemente | |
| 2009/0007751 | A1 | 1/2009 | Ringeride | |
| 2012/0137853 | A1 | 6/2012 | Korfker | |
| 2013/0276611 | A1 | 10/2013 | Vochezer | |

FOREIGN PATENT DOCUMENTS

| | | |
|---|---|---|
| CH | 296 363 | 2/1954 |
| CZ | 12490 | 10/2002 |
| DE | 503 666 | 7/1930 |
| DE | 555 647 | 7/1932 |
| DE | 556 209 | 8/1932 |
| DE | 1 669 269 | 12/1953 |
| DE | 1 692 936 | 2/1955 |
| DE | 1 826 033 | 2/1961 |
| DE | 1 204 055 | 10/1965 |
| DE | 23 56 218 | 5/1975 |
| DE | 26 04 897 | 8/1976 |
| DE | 28 48 610 | 5/1980 |
| DE | 83 00 259 | 7/1983 |
| DE | 36 43 225 | 7/1987 |
| DE | 93 03 031.2 | 4/1993 |
| DE | 201 16 245 | 5/2002 |
| DE | 20 2007 003 473 | 5/2007 |
| EP | 0 180 069 | 5/1986 |
| EP | 0 287 520 | 10/1988 |
| GB | 190906383 | 7/1909 |
| GB | 2 052 828 | 1/1981 |
| JP | S61-179492 | 8/1986 |
| JP | 2008-160595 | 7/2008 |
| WO | WO 80/02617 | 11/1980 |
| WO | WO 2004/077398 | 9/2004 |
| WO | WO 2006/096867 | 9/2006 |
| WO | WO 2006/117564 | 11/2006 |

* cited by examiner 142
136
134
138
16
78a
166
82
78b
26
158
18
172
190
28
162
136′
170a
24
164
168
152
170b
144
134′
146
148
154
158
126
124
110
156
140
120
118
160
114
22
120
112
186
184
132
192
116
188
174′
164′
128
100
130
86
142
104
166′
92
90
98

106
102
128′
20
130′
88

SHOULDER SUPPORT FOR A MUSICAL INSTRUMENT

CROSS-REFERENCE TO RELATED APPLICATIONS

This application is a continuation of international application number PCT/EP2012/054990, filed on Mar. 21, 2012, which is a continuation-in-part of international application number PCT/EP2011/072767, filed on Dec. 14, 2011, both which are incorporated herein by reference in their entirety and for all purposes.

BACKGROUND OF THE INVENTION

The invention relates to a shoulder support for a musical instrument, comprising a holding device, by means of which the shoulder support is fixable or fixed to the musical instrument, at least one arm, which is fixable or fixed to the holding device, and a shoulder abutment element, which is fixable or fixed to the at least one arm and has a pad and a pad holder.

A shoulder support is, for example, used on a violin or viola in order to support the musical instrument on the musician's shoulder.

A shoulder support for a violin is known from DE 691 02 908 T2 (EP 0 445 632 B1), comprising a support piece, which is intended to be supported on the shoulder of the violinist. The support piece is fastened rigidly to an arm, but adjustably with respect to the inclination and angle relative to the arm and with respect to the position along this arm. The arm is rigidly fastened to the base of a chin support, the base being located under the violin. A single head screw connects the support piece to the arm in the adjusted position both along the arm and with respect to the oblique position transverse to the arm. The head screw passes through a first clamping piece, the support piece, a second clamping piece and the arm in order to engage in a third clamping piece under compression between the arm, the support piece and the first and the second clamping piece. The first and second clamping piece have surfaces, which are complementary to one another and at least approximately spherical cap-shaped.

A shoulder support for a violin or the like is known from WO 2006/117564 A1, which has a fastening plate, a shoulder pad and a support arm to connect the mounting plate and the shoulder pad. The mounting plate can be fixed to the sound box of a musical instrument and the mounting plate and/or the shoulder pad have a fitting to receive one end of the holding arm by means of an insertion connection, which is secured by spring-loaded detents. The end of the holding arm and the fitting have means to prevent a rotation of the holding arm relative to the fitting after an engagement.

Chin holders for a musical instrument are known from DE 83 00 295 U1 and EP 1 067 508 A2.

A shoulder support for violins consisting of a pad is known from DE 213 995, the support being releasably connected, with the interposition of a ball-and-socket joint, to the chin support, so as to be fixable in every position.

A removable shoulder support for violins is known from CH 277 350, in which the part of the support coming to rest on the deltoid and pectoral muscles of the violinist in the use position is provided with incisions, which allow its deformation in accordance with the body shape of the violinist, and the connection of the support to the violin is configured in such a way that the latter can be adjusted in relation to said support both with respect to the height and also in the direction towards the body and away from the body as well as inclined to all sides.

A shoulder support for a violin is known from EP 0 287 520 A1.

Shoulder supports are, for example, known from U.S. Pat. Nos. 2,746,336, 1,416,644, 1,971,552, WO 2006/096867 A2, EP 0 287 520 A1, WO 80/02617 A1, U.S. Pat. No. 2,208,824, EP 0 567 050 A1, CZ 12490 U1, U.S. Pat. Nos. 4,212,222, 2,483,052, 744,673, DE 23 56 218 A1, US 2009/0007751 A1, AU 314 335, CH 296363, CH 529 409, DE 30 21 047 C2, DE 36 43 225 A1, DE 100 07 834 A1, DE 201 16 245 U1, DE 199 09 972 B4, DE 213995, DE 293368, DE 503666, DE 555647, DE 556209, DE 1 204 055, DE 1669269, DE 1 692 936, DE 1 826 033, DE 2 009 097, DE 20 09 097, DE 25 11 466 A1, DE 26 04 897 A1, DE 28 48 610 C2, DE 40 91 689 C1, DE 75 08 303 U1, DE 93 03 031 U1, DE 195 00 066 A1, DE 295 00 054 U1, DE 603 14 296 T2, DE 693 19 487 T2, DE 10 2007 038 004 A1, DE 20 2007 003 473 U1, EP 0 180 069 A2, EP 0 445 632 A1, US 2005/0126353 A1, US 2004/0011182 A1, U.S. Pat. Nos. 1,156,925, 1,756,676, 2,064,925, 2,110,023, 2,248,854, 2,489,101, 3,690,211, 3,896,694, 4,084,477, 4,884,487, 6,670,533 B1, 6,680,431 B2, 7,064,258 B2, 7,659,463 B2, 6,927,328 B2 or WO 2004/077398 A1.

SUMMARY OF THE INVENTION

In accordance with the present invention, a shoulder support is provided, which can easily be individually adapted.

In accordance with an embodiment of the invention, the pad holder is movably held on an arm connecting part of the shoulder abutment element by means of a pad holder joint device.

The pad holder is movably held on an arm connecting part of the shoulder abutment element by means of a pad holder joint device. An adaptation of the pad to body contours can easily thus be achieved by means of a corresponding movement and setting of a corresponding position of elements of the pad holder. An introduced pressure can be uniformly distributed over the entire area by means of the pad holder joint device. The pad can be prevented from escaping to one side and the support function is thus secured. Moreover, it can then thus easily be achieved that the pad is twistable and inclinable per se.

In particular, the pad holder joint device comprises at least three joints that are spaced apart and, in particular, four joints that are spaced apart. A uniform pressure distribution with respect to the surface can thus be easily and safely achieved in order to prevent the pad escaping to one side.

It is favorable, in particular, if the second joint device is arranged between at least one joint and, in particular, two joints that are spaced apart on one side and at least two joints that are spaced apart on an opposite side. At least three (and preferably at least four) joints of the pad holder joint devices are then thus provided, the second joint device being positioned to fix the joint of the shoulder abutment element on the at least one arm between joints of the pad holder joint device.

In an advantageous embodiment, the pad holder joint device comprises ball-and-socket joints. In particular, the pad holder has receivers for respective ball heads of ball-and-socket joints. A wide positioning spectrum for the pad holder can thus be achieved. In particular, a pad can thereby be positioned in a twistable and inclinable manner per se.

In one embodiment, a first rocker element and a second rocker element are arranged on the arm connecting part, the first rocker element and the second rocker element in particular being movably mounted on the arm connecting part. This produces a wider positioning scope for a pad holder.

It is favorable if at least some joint heads of the pad holder joint device are formed on the first rocker element and the second rocker element. This allows the arm connecting part to be constructed in a simple manner. For example, a center part is provided, on which the first rocker element and the second rocker element are held. A joint head can in turn easily be formed in one piece on the rocker elements, which are, in particular, injection-molded plastics material parts and, in particular, two or more joint heads can be formed.

It is quite particularly advantageous if the pad holder comprises receiving elements that are spaced apart for respective receivers for joint heads of the pad holder joint device, receiving elements that are spaced apart being connected by at least one web and adjacent receiving elements being movable relative to one another by the at least one web and, in particular, being movably settable, the pad holder in particular being formed in one piece. Owing to the at least one web element between adjacent receiving elements, a flexibility is achieved that allows an adjustable positioning of adjacent receiving elements relative to one another. A web element can be movable here and/or movably arranged (such as, for example, by one or more hinges) and/or be so flexibly formed that a relative movability of adjacent receiving elements is made possible. As a result, extensive adjustment possibilities are produced for adaptation to the body contour. Furthermore, pressure can be introduced in a planar manner and a one-sided pressure loading (with the risk of the "escape" of the pad) is avoided. Basically, a web member can also be formed by the pad or on the pad.

In one embodiment, the (at least one) arm is held on the holding device by means of a first joint device and/or the shoulder abutment element is held on the arm by means of a second joint device, a first fixing device being associated with the first joint device, by means of which first fixing device a relative position is settable between at the least one arm and the holding device and wherein a second fixing device is associated with the second joint device, by means of which second fixing device a relative position is settable between the shoulder abutment element and the at least one arm.

Therefore, a part of the first joint device can be formed as a fixing element to fix and, in particular, releasably fix the at least one arm to the holding device and/or a part of the second joint device can be formed as a fixing element to fix and, in particular, releasably fix the shoulder abutment element to the at least one arm.

In the solution according to the invention, either the first joint device is provided or the second joint device is provided or both the first joint device and the second joint device are provided.

A relative spatial position of the at least one arm with respect to the holding device and/or the shoulder abutment element with respect to the arm is adjustable and settable by means of a corresponding joint device. A musician can thus easily individually adapt the shoulder support. For example, he can adjust a relative pivoting position of the arm with respect to the holding device and also a height position of the shoulder abutment element with respect to the holding device by means of the first joint device. By means of the second joint device, he can, for example, adjust a relative pivoting position of the shoulder abutment element with respect to the at least one arm.

If, for example, the first joint device and the second joint device are provided, at least five degrees of freedom are available for a user for the adjustability of the shoulder abutment element. By means of the first joint device, he can, for example, adjust a height position with respect to the sound box of the musical instrument and he can adjust a position transversely to a longitudinal axis of the musical instrument. Furthermore, in particular by means of the second joint device, he can rotate the shoulder abutment element about an axis, which is transverse and at least approximately perpendicular, to the sound box of the musical instrument. Furthermore, he can also tilt the shoulder abutment element along an axis of the musical instrument and tilt it transversely to the axis of the musical instrument.

By means of the corresponding first fixing device or second fixing device, a selected adjustment is fixed and therefore secured. This adjustment can be maintained even if, for example, the at least one arm is released from the holding device and/or the at least one arm is released from the shoulder abutment element. The shoulder support can thus be easily transported, the holding device being able to remain fixed on the musical instrument, in particular. If the shoulder support is then assembled again the individual adjustment once selected is mechanically "stored" by means of the first joint device and/or the second joint device.

A part of the first joint device is configured as a fixing element to fix and, in particular, releasably fix the at least one arm on the holding device and/or a part of the second joint device is configured as a fixing element for fixing and, in particular releasably fixing the shoulder abutment element on the at least one arm. As a result, a structurally simple construction is produced while minimizing the components.

In particular, the first joint device and/or the second joint device are configured as a ball-and-socket joint device. As a result, there are extensive adjustment possibilities for the relative position between the at least one arm and holding device or shoulder abutment element and the at least one arm. As a result, the shoulder support can in turn be individually adapted in an optimized manner.

It is advantageous if the first joint device and/or the second joint device comprise a joint socket and a joint body movable in the joint socket. In particular, the joint body is guided in a sliding manner in the first joint socket. A corresponding joint device and, in particular a ball-and-socket joint device can thus be easily formed.

It is advantageous if the joint socket has a concave spherical shape and the joint body has a convex spherical design. As a result, a ball-and-socket device can easily be formed. A joint socket or a joint body can easily be formed in one piece, for example on the arm. The number of components can thereby be minimized.

In particular, the joint socket is arranged on a first device and the joint body is arranged on a second device. For example, a joint socket is arranged on the at least one arm and the joint body is arranged on a separate element. It may also be provided that the joint body is arranged on the at least one arm and the joint socket is arranged on a separate body. The arrangement may be different for the first joint device and the second joint device. It is basically also possible that, for example, the joint socket or the joint body are positioned on the holding device or on the shoulder abutment element.

It is advantageous if the first fixing device and/or the second fixing device are configured as a clamping device, by means of which the joint body and the joint socket are clampable to one another. A captive hold of the joint socket on the joint body is thereby first of all obtained. By corresponding preloading of the clamping device, a relative position can be adjusted. By further clamping, the relative position (for example between the arm and holding device or shoulder abutment element and arm) can thus be set. This setting is, in particular, permanent, in this case and remains even after the release of the arm from the holding device or of the shoulder abutment element from the arm.

In particular, a first element is provided, which abuts an outer side of the first device opposite to the joint socket and a second element is provided, which abuts on an outer side of the second device opposite to the joint body, the first element and the second element being connected to one another. By means of a clamping force, which is exerted between the first element and the second element, the corresponding joint device with the joint body and joint socket can be held together. By increasing the clamping force, a specific relative position of the joint body in the joint socket can be set.

For example, of the first element and the second element, one element is a screw with an abutment head and the other element of the first element and the second element is a nut, on which the screw is guided. As a result, a clamping force can easily be achieved, which can be actuated in a proportioned manner, in order, for example, to easily allow an adjustment and then ensure a specific adjustment by increasing the clamping force, in other words to set it.

In particular, for the first joint device of the first device and the second device, one device is the arm or the holding device and the other device is a fixing element for, in particular, releasable fixing of the at least one arm on the holding device. As a result an, in particular, releasable fixing element for fixing the arm on the holding device can also be easily realized by means of the joint device. As a result, the number of components can be kept small. Furthermore, the dimensions of the shoulder support can thus be optimized.

For the same reason, it is advantageous if for the second joint device of the first device and the second device, one device is the arm or the shoulder abutment element and the other device is a fixing element for, in particular, releasable fixing of the shoulder abutment element on the at least one arm. A fixing element, which is simultaneously part of the joint and is used for fixing the shoulder abutment element on the arm, is then also provided for the second joint device.

In one embodiment, the first joint device and/or the second joint device are arranged on the at least one arm. This produces a structurally simple construction.

It is advantageous if the first joint device and the second joint device are arranged on opposite sides of the at least one arm. It is thereby possible, for example, to place the at least one arm from above onto the holding device and it is furthermore possible to place the shoulder abutment element from above onto the at least one arm, the fixing being able to take place between the arm and holding device or shoulder abutment element and arm with the aid of the joint devices.

In a structurally simple embodiment, either the holding device or the at least one arm has an opening, at which a fixing element of the at least one arm or the holding device is insertable or inserted. As a result, a releasable fixing of the at least one arm on the holding device or of the shoulder abutment element on the at least one arm can easily be achieved. The fixing element is inserted in the corresponding opening and an anti-lifting mechanism is ensured. As a result, a corresponding fixing is achieved.

For the same reason, it is favorable if either the shoulder abutment element or the at least one arm has an opening, at which a fixing element of the at least one arm or the shoulder abutment element insertable or inserted. As a result, the shoulder abutment element, for example, can be placed and fixed on the at least one arm.

In particular, it is provided that the opening has an axis, which is oriented at least approximately perpendicular to the sound box when a holding device is fixed on a sound box of the musical instrument. ("Approximately" is taken to mean here that the deviation from the perpendicular is at most 25°.) This allows the at least one arm to be inserted onto the holding device from above. Scratching of a sound box of the musical instrument is, for example, substantially avoided thereby. Furthermore, the fixing can be easily achieved.

An anti-lifting mechanism is preferably formed on the fixing element and the opening in particular in the form of a bayonet catch. The anti-lifting mechanism ensures that the fixing element of the corresponding counter-device (for example the holding device or the shoulder abutment element) is connectable in an axially secured manner.

In a structurally simple embodiment, the anti-lifting mechanism comprises at least one strip, which is, in particular, arranged at the opening and which is insertable in a groove, the groove, in particular, being arranged on the guide element. When the corresponding strip is inserted in the associated groove, an axial anti-lifting mechanism is then achieved, in other words the fixing element can no longer be removed from the opening.

It is, in particular, advantageous if an insertion into the groove or grooves can be brought about by a rotational movement of the fixing element relative to the opening in order to provide an anti-lifting mechanism. A musician can then easily and quickly assemble a shoulder support or disassemble it.

It is advantageous if a stop is provided, which blocks a further rotation. A defined position is thereby provided with respect to the rotational movement. This defined position is a blocking position.

It is then furthermore advantageous if an anti-rotation device is provided, by means of which a rotational position and in particular a blocking position can be secured. This prevents the at least one arm being able to be released from the holding device or the shoulder abutment element being able to be released from the at least one arm, in particular during the playing of the musical instrument, in an unintentional manner.

In a structurally simple embodiment, the anti-rotation device comprises a pivotable or rotatable element, which is placed in a blocking position on the fixing element. When the anti-rotation device is the blocking position, the at least one arm cannot be released from the holding device or the shoulder abutment element from the at least one arm by moving the arm or the shoulder abutment element.

It is advantageous if the pivotable or rotatable element is mounted on the device, on which the opening is formed. If, for example, the opening is formed on the holding device, the pivotable or rotatable element is then preferably mounted on the holding device. This produces a simple structural construction of the shoulder support. For example, an opening adjacent to this opening and, in particular, an opening running into it can be used as a rotational bearing for the pivotable or rotatable element.

It is quite particularly advantageous if the at least one arm and/or the holding device are produced from a plastics material, elements provided with a thread also being able to be produced from a metallic material. As a result, the shoulder support can be formed with a low mass. As a result, under some circumstances, the acoustic pattern of the musical instrument is also minimally influenced with the shoulder support fixed thereon. It can basically be provided here that few elements and, in particular, screws with associated nuts, which are used to exert clamping forces, are produced from a metallic material. Wear can thereby be reduced and therefore the service life of the shoulder support increased in comparison to the case where these elements are also produced from a plastics material.

It may also be advantageous if the pad holder is plastically formable with respect to a receiving space for the pad. This produces a further individual adaptation possibility for the musician. The latter can adapt the pad holder and therefore also the pad to the shape of his shoulder, for example.

In one embodiment an adjustment element for a setting angle of the at least one arm with respect to the holding device and/or of the shoulder abutment element on the at least one arm is arranged on the at least one arm. Owing to the adjustment element, a type of preselection for the setting angle can be adjusted in order, for example, to allow a position once adjusted to be noted or a more rapid adjustment.

In particular, the at least one arm is provided with a guide and, in particular, sliding guide for the adjustment element, a position of the element to be adjusted in the guide predetermining a setting angle, and, in particular, a height, by which the adjustment element projects beyond the at least one arm, being adjustable. The adjustment element may be configured as a type of latch. The height, by which the abutment region projects beyond the at least one arm, determines when the adjustment element contacts the holding device or the shoulder abutment element by means of its abutment region. The setting angle can in turn be preselected thereby.

In a simple embodiment, an adjustment element is fixed on the at least one arm and/or an adjusted position of the adjustment element is fixed on the guide by a force-locking connection. The force-locking connection brings about a captive fixing or it fixes an adjusted position and, in particular, sliding position. The guide and the adjustment element can therefore be configured in a simple manner.

In particular, the adjustment element has an abutment region for contact with the holding device and/or the shoulder abutment element. This abutment region is a blocking face, which predetermines the setting angle.

In one embodiment, a chin holder is fixable or fixed on the holding device. The musical instrument with the shoulder support fixed thereon can thereby be clamped between the chin and shoulder, the chin of the musician not directly touching the sound box of the musical instrument, but the chin holder. This produces ergonomic advantages for the musician.

In particular, it is provided that a chin support of the chin holder and a holding plate of the holding device form clamping elements, between which a sound box of the musical instrument can be clamped, the chin support and the holding plate being connected by at least one clamping element. As a result, the shoulder support can be clamped by the chin holder and the holding plate on the sound box of the musical instrument. The chin support is to a certain extent a counter-joint element with respect to the chin element holding plate.

In one embodiment, it is provided that the chin support has an insertion guide for the at least one clamping element and the insertion guide is arranged and configured in such a way that an insertion direction is oblique with respect to the clamping direction. As a result, a clamping element can be realized, which at least outwardly has no metallic parts. As a result, the contact of metallic parts with the skin of the musician can be prevented. Corresponding clamping elements are described in EP 1 067 508 A2 to which reference is expressly made.

The following description of preferred embodiments is used for a closer description of the invention in conjunction with the drawings.

BRIEF DESCRIPTION OF THE DRAWINGS

FIG. 8(*b*) shows a corresponding view of the same region from an opposite side (corresponding to the view according to FIG. 4);

FIG. 9(*b*) shows the same view as in FIG. 8(*b*) with securing of the rotational position;

FIG. 10(*b*) shows a different view of the anti-rotation device according to FIG. 10(*a*);

FIG. 11(*b*) shows the same view as FIG. 10(*b*) in a securing position;

FIG. 12(*b*) shows a view of the anti-rotation device according to FIG. 12(*a*) from another side;

DETAILED DESCRIPTION OF THE INVENTION

Figure 1:
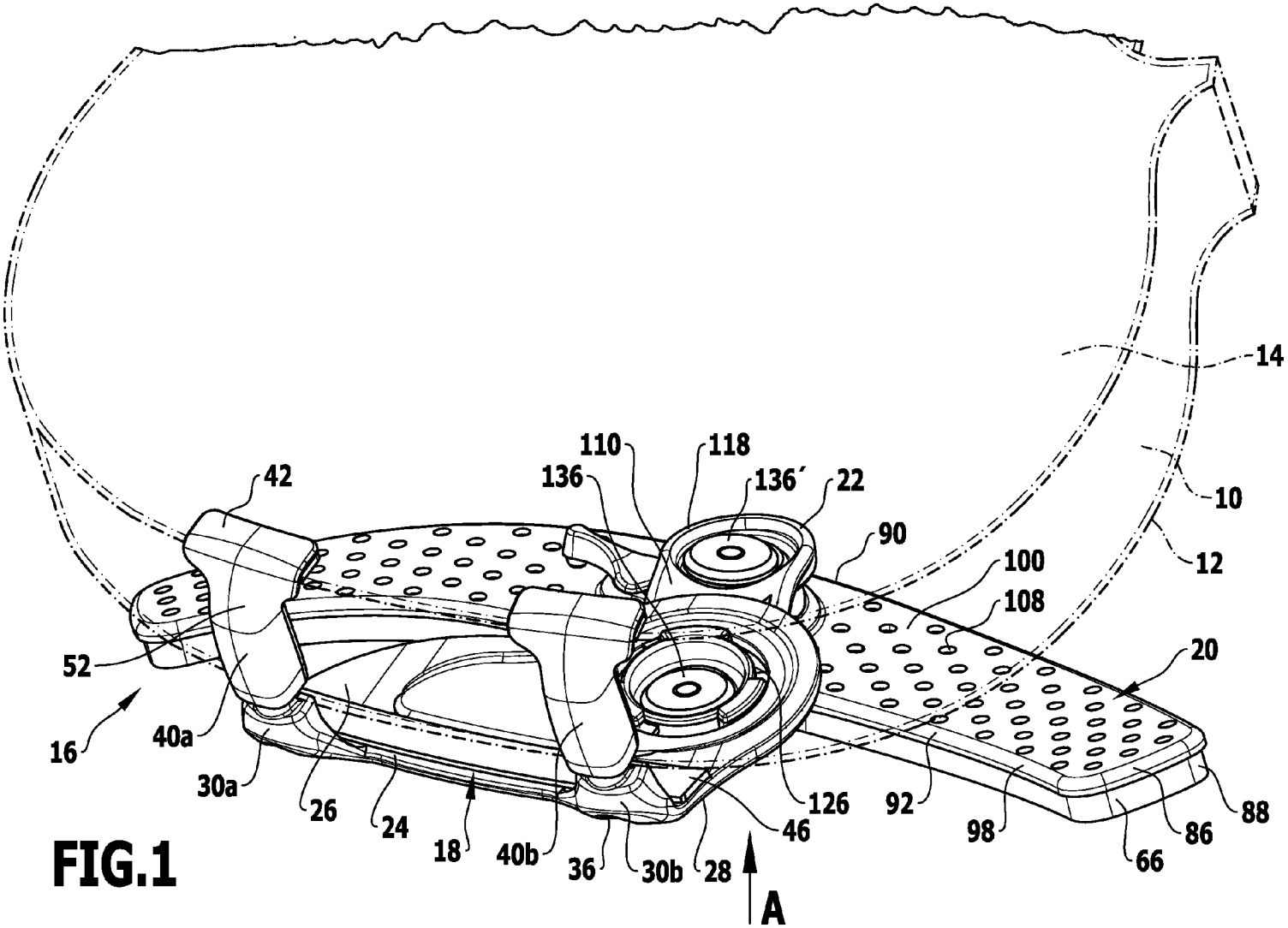
FIG. 1 shows a perspective view of an embodiment of a shoulder support, a fixing on the sound box of a musical instrument being indicated.
Figure 2:
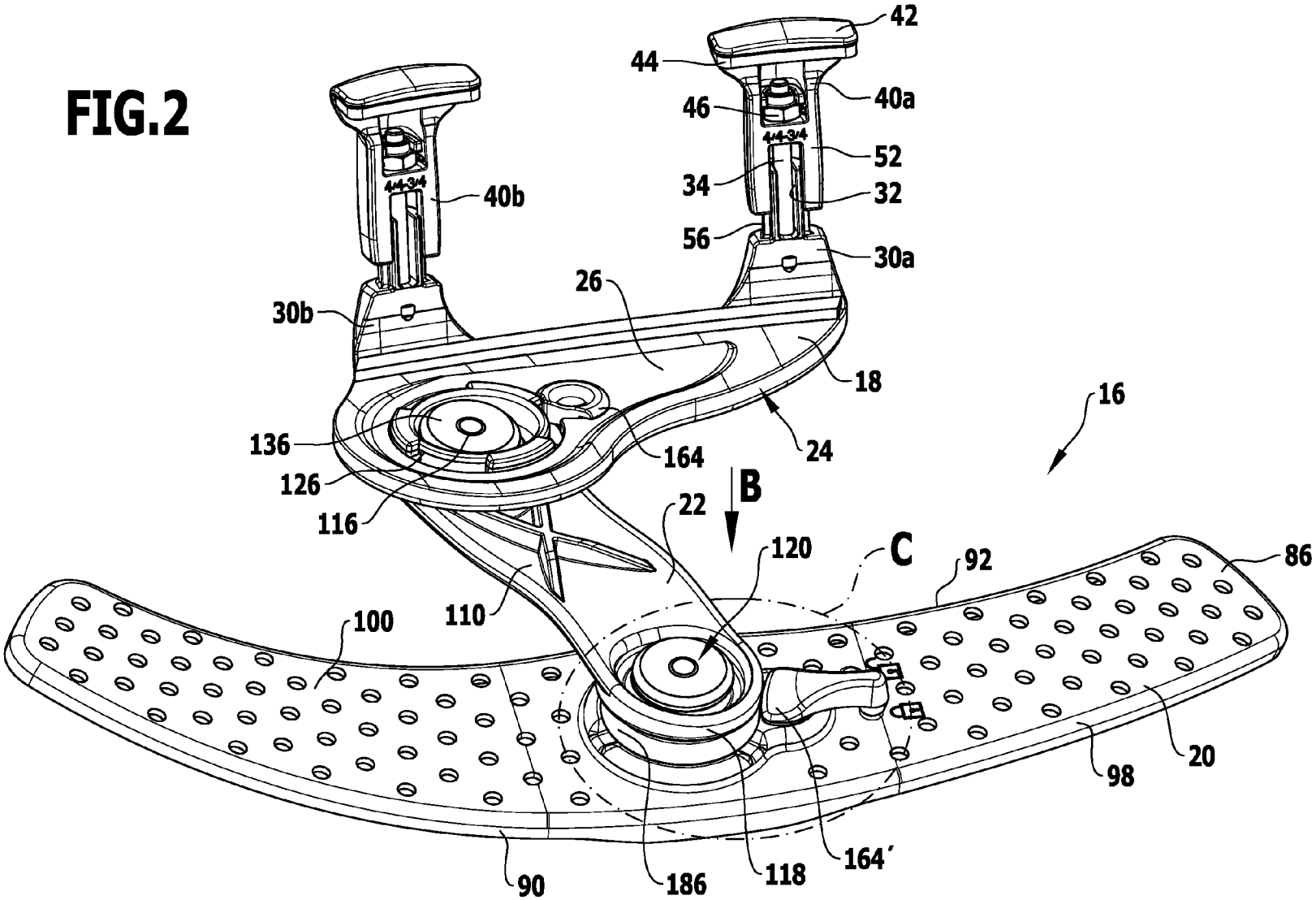
FIG. 2 shows a different perspective view of the shoulder support according to FIG. 1.

A musician can support a musical instrument such as a violin or a viola on his shoulder by means of a shoulder support. The shoulder support is fixed, for this purpose, on a sound box 10 (FIG. 1) of the musical instrument, the fixing region being on a bridge end of the sound box 10, the shoulder support being fixed between the base 12 and top 14 of the sound box 10.

One embodiment of a shoulder support, which is shown in FIGS. 1 to 7 and designated 16 there, comprises a holding device 18, by means of which the shoulder support 16 can be fixed to the sound box 10, a shoulder abutment element 20, which can be placed on the shoulder of the musician, and an arm 22, which is fixed, in particular releasably, to the holding device 18 and is fixed, in particular releasably, to the shoulder abutment element 20.

The holding device 18 comprises a holding plate 24 with a lower side 26, which, when the shoulder support 16 is fixed, faces the base 12 of the sound box 10. Furthermore, the holding plate 24 has an upper side 28 opposite to the lower side. The holding plate 24 is flat. The spacing between an envelope of the lower side 26 and an envelope of the upper side 28 is at least approximately constant.

Figure 7:
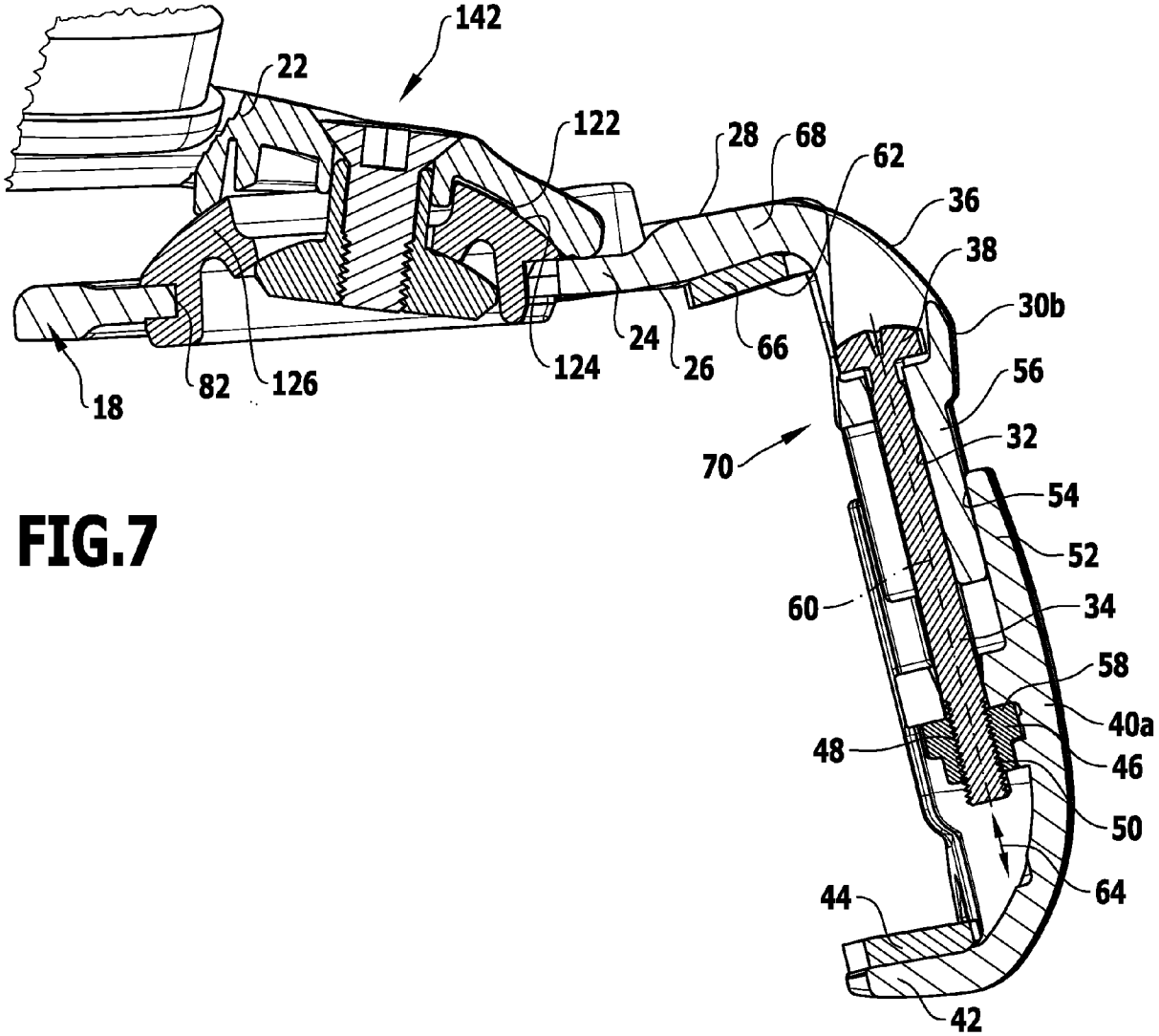
FIG. 7 shows a sectional view along the line 7-7 according to FIG. 4 with a clamping element (not shown in FIG. 4)

The holding plate 24 is, in particular, produced from a plastics material. A first flange 30*a* and a second flange 30*b* are arranged thereon. These are spaced apart from one another. The first flange 30*a* and the second flange 30*b* have a guide channel 32 for a screw 34 in each case (FIG. 7). The guide channel is open in the direction of the upper side 28 by way of a mouth opening 36. As a result, it is possible to act on a screw head 38 from this side with a screwdriver or the like.

A first clamping element 40*a* is associated with the first flange 30*a* and a second clamping element 40*b* is associated with the second flange 30*b*. A clamping element 40*a*, 40*b* of this type has a foot 42, which can be placed on the base 12 of the sound box 10. A pad 44, which comes into direct contact with the musical instrument, is seated, in particular, on the foot 42. The pad 44 is, for example, formed by a cork piece. The respective clamping element 40*a*, 40*b* has a counter-element 46, which is non-rotatably arranged on the first clamping element 40*a* or second clamping element 40*b*. This counter-element 46 is provided with an internal thread 48, in which an external thread 50 of the screw 34 engages. The counter-element 46 is, for example, formed by a nut seated non-rotatably on the first clamping element 40*a*.

It may be provided that the first clamping element 40*a* and the second clamping element 40*b* are produced from a plastics material. It is basically possible here for the screw 34 and the counter-element 46 to not be produced from a plastics material, and are produced, for example, from a metallic material. The clamping elements 40*a*, 40*b* are then, in particular, configured in such a way that they outwardly cover the corresponding screw 34, so that it cannot touch the skin of the musician, but at most plastics material touches the skin. As a result, a protection against allergy is realized.

The first clamping element 40*a* or the second clamping element 40*b* have a, for example, groove-like element 52, which has an abutment region 54 on the corresponding first flange 30*a* or second flange 30*b*. In particular, one element 56 of the respective flange 30*a*, 30*b*, on which the guide channel 32 is formed, can be inserted into the groove-like element 52 on the abutment region 54.

A receiving region 58 for the counter-element 46, on which the latter is non-rotatably fixable, is formed on the element 52, which is, in particular, formed in one piece.

It is basically also possible here for an internal thread for the screw 34 to be directly formed in the element 56.

The internal thread 48 and the external thread 50 have coaxial axes 60. By corresponding rotational positioning of the screw 34, the spacing between an abutment region 62 of the holding plate 24 on the base 12 of the sound box 10 of the musical instrument and the pad 44 can be adjusted. By means of the screw 34, a clamping force with a clamping direction 64 parallel to the axis 60 can be exerted, so the holding device 18 is clampable on the sound box 10 between the base 12 and top 14.

A pad 66, which, in particular, is formed by a cork element, is arranged here on the abutment region 62 of the holding plate 24.

In one embodiment, corresponding pads 66 lie directly behind the flanges 30*a* and 30*b*. A connecting line between the pads 44 and 66, in each case, for the first flange 30*a* and the first clamping element 40*a* or the second flange 30*b* and the second clamping element 40*b* is located here at least approximately parallel to the clamping direction 64; the pads 44 and 66 associated with one another are oriented aligned with respect to one another.

An operator can bring about a rotation of the screw from the upper side 28 through the mouth 36 and thereby fix the holding device 18 on the sound box 10 or release a fixed holding device 18.

In one embodiment, the first flange 30*a* and the second flange 30*b* are connected in one piece with the holding plate 24.

In an alternative embodiment, the first flange 30*a* and the second flange 30*b* are connected to one another by a bridge 68. In particular, the bridge 68 and the flanges 30*a* and 30*b* are connected to one another in one piece. This combination of bridge 68 and flanges 30*a*, 30*b* is an element separated from the holding plate 24. This element 70 can be fixed with respect to the holding plate 24. For this purpose, the holding plate 24 has a recess 72 on its upper side 28. The recess 72 is limited toward the edge of the holding plate 24 by a web 74, which defines an undercut region 76. The web 74 is limited toward both sides by openings 78*a*, 78*b*. The element 70 can be inserted in the recess 72, the first flange 30*a* then being inserted in the opening 78*a* and the second flange 30*b* being inserted in the opening 78*b*. When the holding plate 24 is clamped with the sound box 10, the bridge 68 is pressed into the recess 72. The web 74 forms a blocking face with respect to pulling the element 70 away from the holding plate 24. A limiting face 80 of the recess 72 on the holding plate 24 forms a further blocking face. The undercut region 76, in which the bridge 68 is inserted, ensures a certain prefixing of the element 70 on the holding plate 24 in relation to the clamping direction 64.

It is basically also possible for the recess 72 to be used to receive a bridge, which is arranged on a chin holder, and, in this case, is a clamping element of the chin holder on the sound box 10 of the musical instrument. If the corresponding bridge is inserted in the recess 72, where the chin holder is clamped, the holding plate 24 is also clamped thereby on the musical instrument and the shoulder support thereby fixed.

In the embodiment described, the holding device 18 with the holding plate 24 and the element 70 is formed in two parts. If the holding device 18 is accordingly disassembled into the holding plate 24 and element 70, the latter can be more easily transported or accommodated in a smaller packaging.

Figure 3:
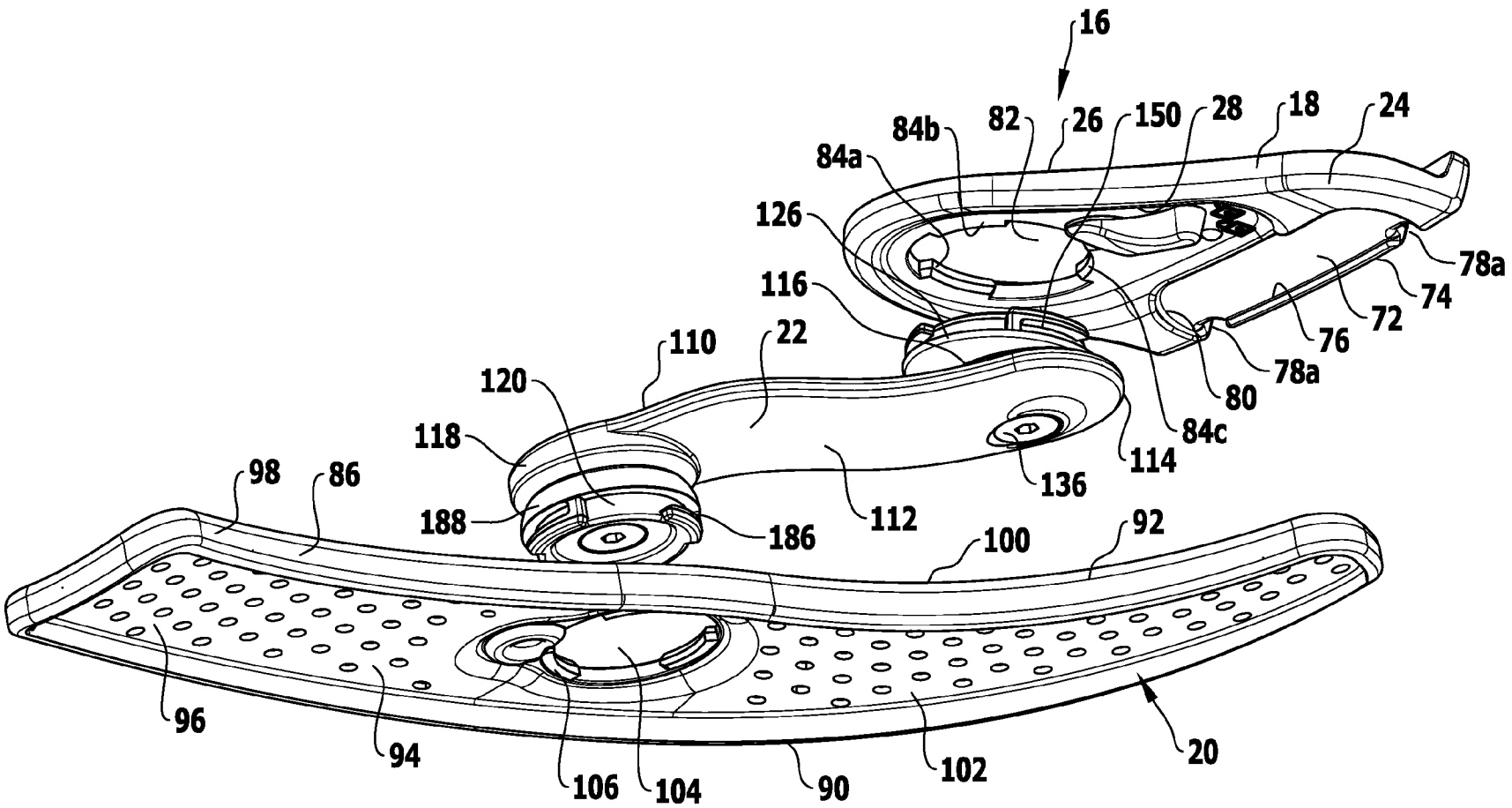
FIG. 3 shows a further perspective view of the shoulder support according to FIG. 1, one arm being released from a holding device and a shoulder abutment element.
Figure 4:
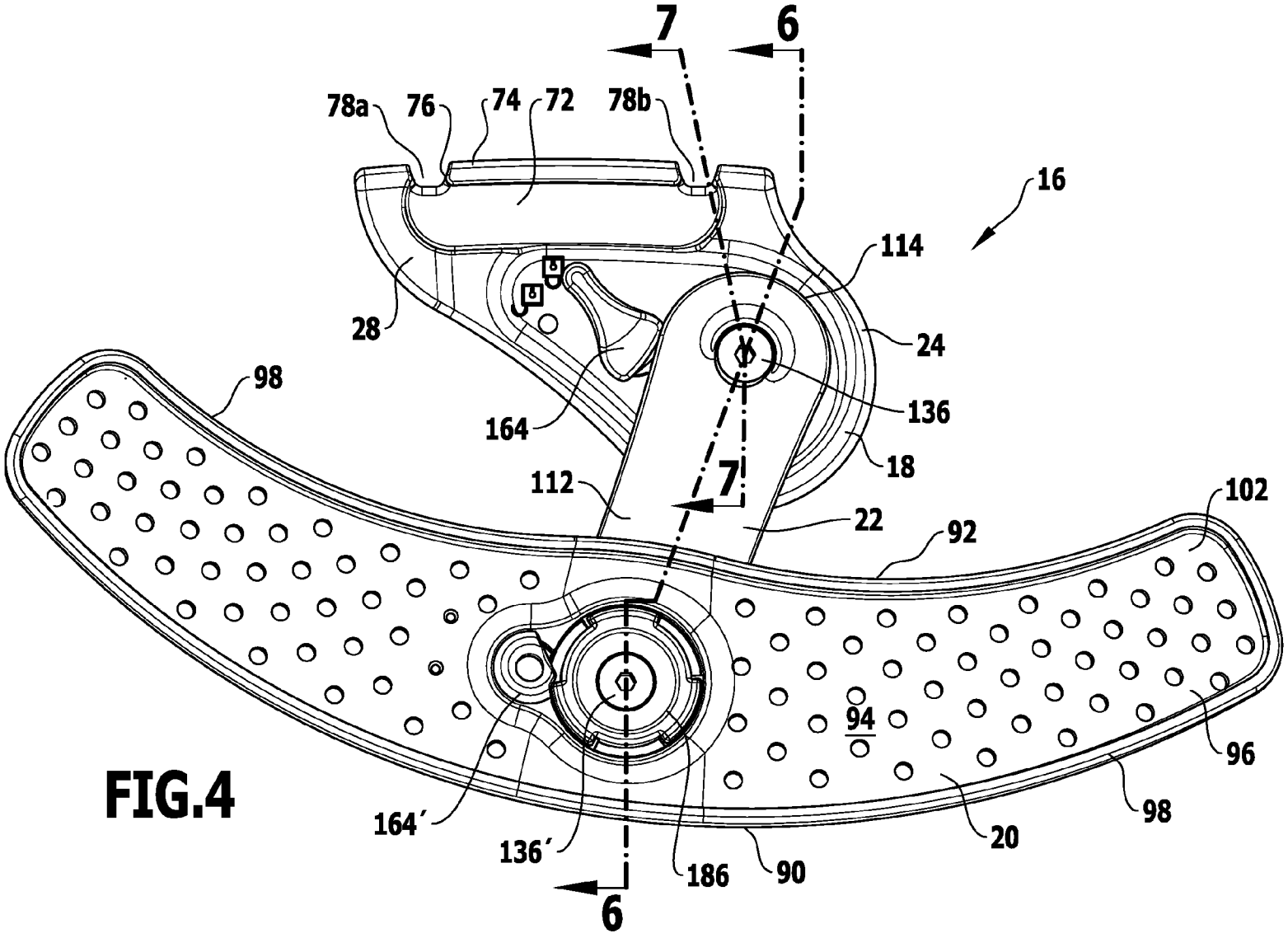
FIG. 4 shows a plan view of the shoulder support according to FIG. 1 in the direction A.
Figure 5:
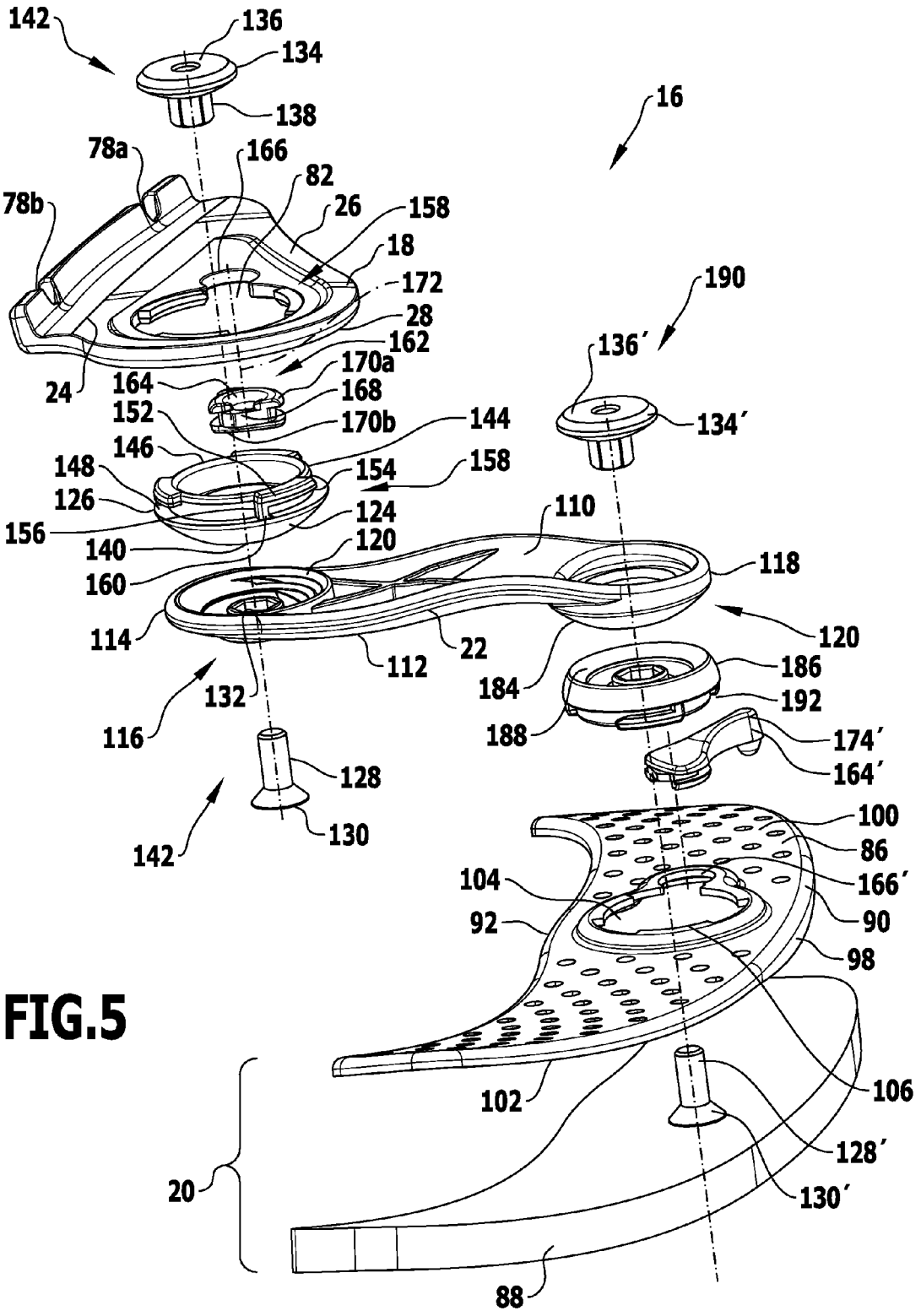
FIG. 5 shows an exploded view of the shoulder support according to FIG. 1.
Figure 6:
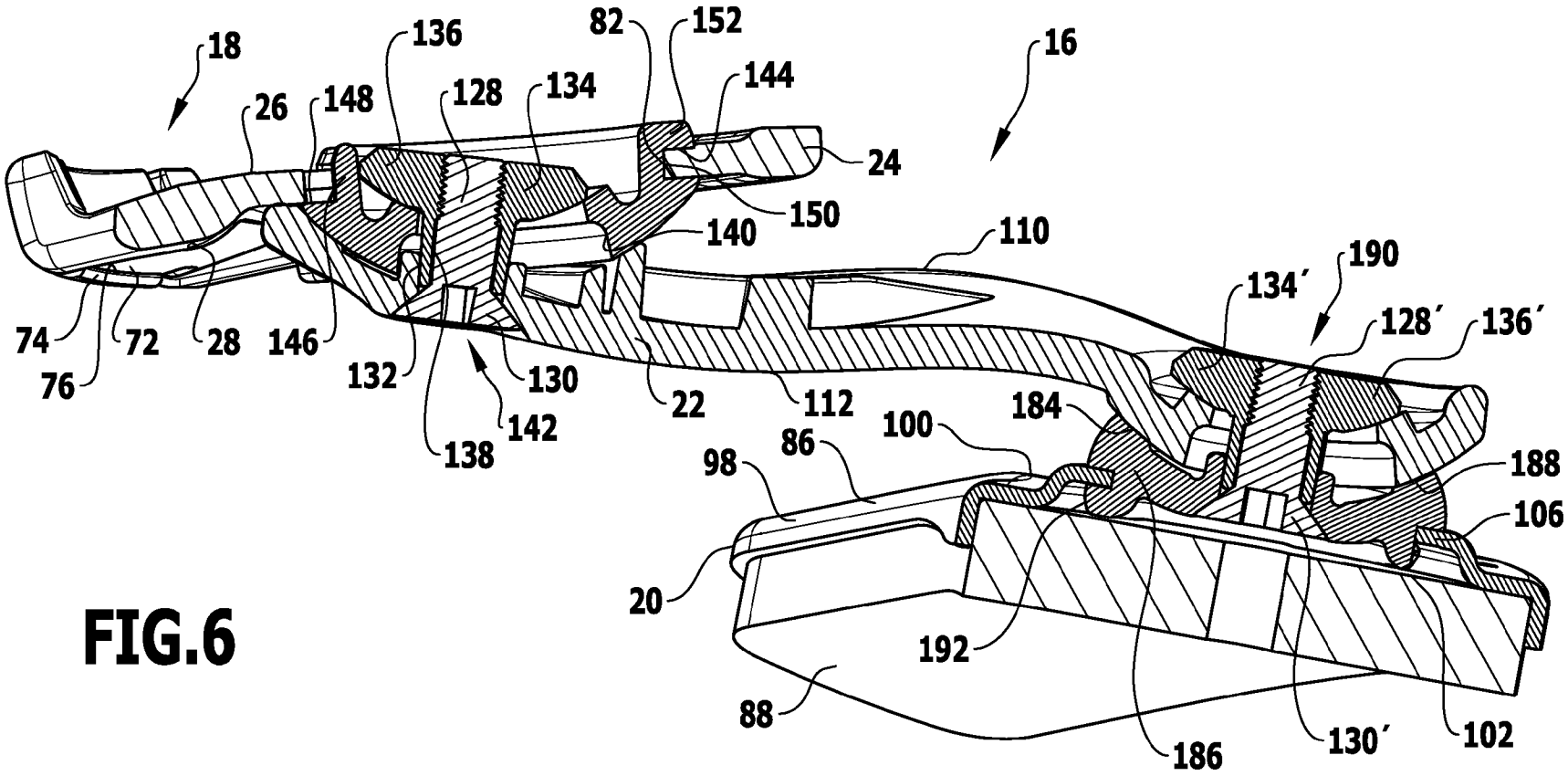
FIG. 6 shows a sectional view along the line 6-6 according to FIG. 4.

An opening 82 passing through between the lower side 26 and the upper side 28 is arranged in the holding plate 24 (for example FIG. 3). This opening 82, for example, has a circular shape. At its edge, strips 84*a*, 84*b*, 84*c* are arranged at an angular spacing. In one embodiment, three strips 84*a*, 84*b*, 84*c* are provided. These are, in particular, arranged at a uniform angular spacing, which is 120° (based on a radial center line) in the case of three strips. By means of these strips 84*a*, 84*b*, 84*c*, as will be described in more detail below, the arm 22 can be releasably fixed on the holding device 18.

A type of bayonet catch can be realized by the strips 84*a*, 84*b*, 84*c*. When three strips 84*a*, 84*b*, 84*c* are present, a corresponding fixing can be achieved by means of a movement in an angular range of 60°. It is also possible for more than three strips to be present (not shown in the drawings). For example, four such strips are present. A fixing is then correspondingly achieved by a movement in an angular range of 45°.

The shoulder abutment element 20 comprises a pad holder 86, on which a pad 88 (FIG. 5) is arranged. In one embodiment, the pad holder 86 and, correspondingly, the pad 88, have a first limiting contour 90, which is curved. Furthermore, an opposite curved and, for example, repeatedly curved, second limiting contour 92 is provided.

The pad holder 86, in particular, has a receiving space 94 for the pad 88, which is limited by a base element 96 and an edge wall 98 arranged on the base element 96 and, in particular, formed in one piece therewith.

The pad holder 86 is, for example, formed from a plastic metallic material. It can be deformed (together with the pad 88). As a result, a musician can adapt the pad holder 86 with the pad 88 to his shoulder contours.

The base element 96 has a lower side 100, which (when the shoulder support 16 is assembled) faces the holding device 18. Furthermore, it has an upper side 102, which is remote from the lower side 100. Formed between the lower side 100 and the upper side 102 is a continuous opening 104, by means of which the arm 22 can be releasably connected to the shoulder abutment element 20, in particular in the manner of a bayonet catch.

The opening 104 is, in particular, circular. Spaced-apart strips 106 are formed at its edge. For example, three strips are provided, which are located at a uniform angular spacing (based on a radial center line) of 120° with respect to one another. As will be described in more detail below, a fixing of the shoulder abutment element 20 on the arm 22 can thus be achieved in a similar manner to the fixing of the arm 22 on the holding device 18.

The base element 96 may be provided with one or more recesses 108, for example in the form of holes or slots, in order to facilitate the plastic deformation.

The pad 88 is, for example, adhered to the pad holder 86.

The holding plate 24 is configured in the region of the opening 82 in such a way that when the holding device 18 is fixed on the sound box 10, the lower side 26 is spaced apart from the base 12. As a result, on insertion of the arm 22, which will be described in more detail below, scratching of the sound box 10 is avoided.

The arm 22 is the connecting piece between the holding device 18 and the shoulder abutment element 20. The arm 22 has a lower side 110, which, when the shoulder support 16 is fixed on the sound box 10, faces the base 12. It furthermore has an opposite upper side 112, which, when the shoulder abutment element 20 rests on the shoulder of the musician, faces the shoulder. The lower side 110 and the upper side 112, for example, have a curved shape, in order to bring about a correspondingly large spacing between the holding device 18 and the shoulder abutment element 20 when the arm 22 is fixed thereon, in each case. The arm 22 has a first end 114, a first joint device 116 being arranged in the region of this first end 114. It has an opposite second end 118, on which a second joint device 120 is arranged. The relative position between the arm 22 and the holding device 18 can be fixably adjusted by means of the first joint device 116. The relative position between the shoulder abutment element 20 and the arm 22 can be fixably adjusted by means of the second joint device 120. As a result, the musician can individually adapt the shoulder support 16 in an optimized manner.

A length of the arm 22 between the first end 114 and the second end 118 is greater than the width transverse to this longitudinal direction.

The first joint device 116 and the second joint device 120 are, in particular, formed as ball-and-socket joint devices, in order to realize extensive adjustment possibilities.

The first joint device 116 comprises a joint socket 122 with a concave spherical shape. This joint socket 122 is formed on the lower side 110 of the arm 22 and, in particular, formed in one piece.

Furthermore, the first joint device 116 comprises a joint body 124, which has a concave spherical design. A radius of the corresponding (imaginary) ball is matched to the radius of the (imaginary) hollow ball of the joint socket 122. The joint body 124 is located in the joint socket 122 and slides on its surface.

The joint body 124 is in turn formed on a fixing element 126. This fixing element 126 is an element separate from the arm 22. The fixing element 126 is connected to the arm 22 in a captive manner. For this purpose, a screw 128 with an abutment head 130 is provided. An opening 132 is formed in the arm 22 between the upper side 112 and the joint socket 122. This opening 132 is not circular. For example, it has a hexagonal shape. Furthermore a nut 134 is provided, which has an abutment head 136, on which a flange 138 with an internal thread is seated. An external shape of the flange 138 is matched to the shape of the opening 132. The flange 138 can be inserted in the opening 132, an anti-rotation device being provided.

The fixing element 126 also has an opening 140, which lies on one pole of the imaginary ball of the joint body 124, through which the flange 138 is inserted. An abutment region for the abutment head 136 is formed around the opening on a side remote from the joint body 124. The screw 128 rests with its abutment head 130 on the arm 22 and the abutment head 136 rests on the fixing element 126. As a result, the fixing element 126 can be clamped between the abutment head 130 and the abutment head 136. A clamping device 142 is formed, by which the joint body 124 and the joint socket 122 are held on one another in a captive manner and can be clamped to one another. By means of the clamping device 142, a fixing device is simultaneously formed, by which a relative position between the joint body 124 and the joint socket 122 can be secured by clamping. The screw head forms a first element, which abuts an outside 112 of the arm 22 opposite the joint socket 122. The abutment head 136 forms a second element, which abuts an outside of the fixing element 126 opposite the joint body 124. The first element and the second element are connected to one another.

The fixing element 126 can be inserted with a connecting region 144 into the opening 82. The opening 82 forms a fitting for the fixing element 126. The connecting region comprises an annular element 146 here, on which the joint body 124 is seated in one piece. A radius of the annular element 146 is smaller here than a width of the joint body 124 in the corresponding radial direction. An annular abutment face 148 is thereby formed on the fixing element 126, with which the latter can be placed on the upper side 28 of the holding plate.

Grooves 150 are formed on the annular element 146 in accordance with the strips 84*a*, 84*b*, 84*c* on the opening 82. A groove 150 is formed on the annular element 126 between the abutment face 148 and a wall 152. The wall 152 and, accordingly, also a groove 150 extend in the peripheral direction. A groove 150 is open toward one end 154 in order to be able to introduce a strip 84*a*, 84*b*, 84*c*. Toward another end 156, a groove 150 is limited by a wall.

The strips 84*a*, 84*b*, 84*c*, together with the associated grooves 150, form an anti-lifting mechanism 158 for the arm 22 from the holding device 18. The arm 22 can be releasably fixed on the holding device 18. For this purpose, the fixing element 126 is inserted in the opening 82, specifically in such a way that the strips 84*a*, 84*b*, 84*c* are located between adjacent walls 152. When the abutment face 128 abuts the holding plate 24, the corresponding strips 84*a*, 84*b*, 84*c* can be inserted in the corresponding groove 150 at the end 154. This insertion is realized by a corresponding rotational movement. The wall at the end 156, in this case, forms a stop 160, which blocks the further rotation. A securing against axial lifting is thereby achieved.

An anti-rotation device 162 is furthermore provided, by means of which a position of the arm 22 that is secured against lifting can be fixed on the holding device 18.

In one embodiment, the anti-rotation device 162 comprises a rotatable element 164, which is rotatably mounted on the holding plate 24 in the region of the opening 104. For example, formed on the opening 82 and connected thereto is a further opening 166. This opening 166 forms a shaft bearing for the rotatable element 164.

The rotatable element 164 has an, in particular, cylindrically formed shaft 168, which is seated in the opening 166. The shaft is seated between opposite elements 170*a* and 170*b* of the rotatable element 164, the shaft 168 having smaller width dimensions than the elements 170*a* and 170*b*. The element 170*a* abuts on the upper side 26 of the holding plate 24. The element 170*b* abuts the lower side 26 of the holding plate 24. An axial securing is thus provided in relation to a rotational axis 172 of the rotatable element 164.

The opening 166 tapers towards the opening 82. The rotatable element 164 is pushed on over the shaft 168. Owing to the tapering, it is positively held, and therefore held in a captive manner, on the holding plate 24 in the direction of the opening 82.

The rotatable element is, in particular, formed in one piece. It has a latch-type actuating element 174 (for example FIG. 8(*a*)). The actuating element 174 is connected to the element 170*b* and is thus seated on the upper side 28 of the holding plate 24 (see, for example, FIG. 8(*a*)).

Figure 8A:
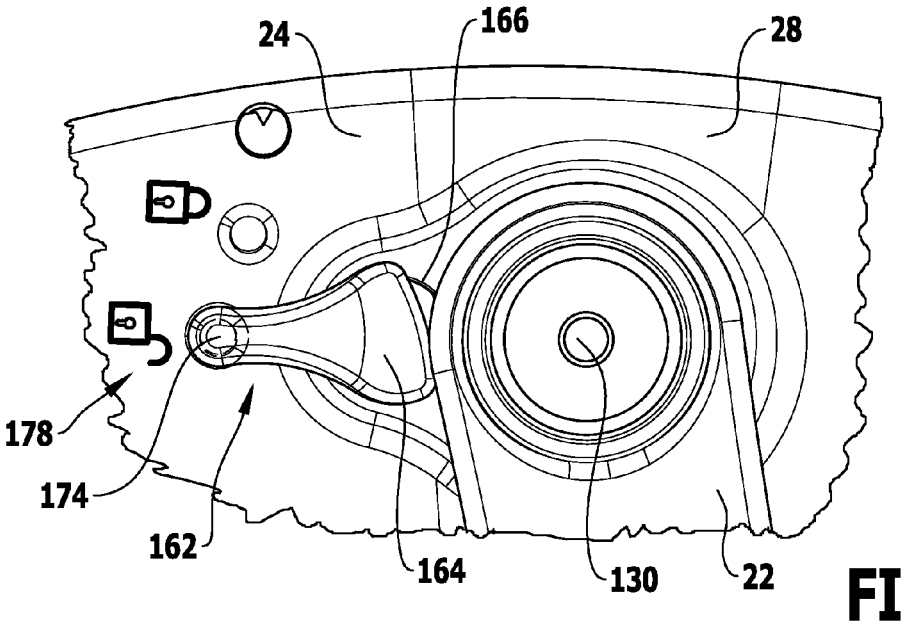
FIG. 8(*a*) shows a plan view in the direction B of the region C according to FIG. 2 without securing of a rotational position (insertion position)
Figure 8B:
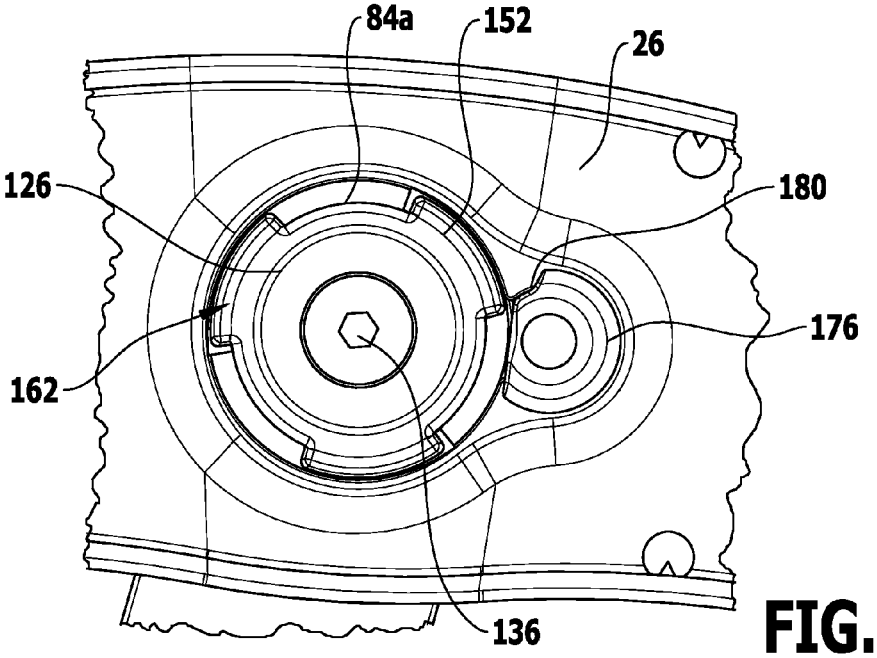

A blocking head 176 (see, for example, FIG. 8(*b*)) is connected to the element 170*a*. Said blocking head is seated on the lower side 26 of the holding plate 24. The shaft 168 extends between the blocking head 176 and the actuating element 174. In a release position 178 (FIG. 8(*a*) and (*b*)) the actuating element 174 and therefore the blocking head 176 are positioned in such a way that the fixing element 126 can be inserted in the opening 82 and can be rotated therein to produce the anti-lifting mechanism. A blocking face 180 (FIG. 8(*b*)) does not touch the wall 152 of the fixing element 126.

Figure 9A:
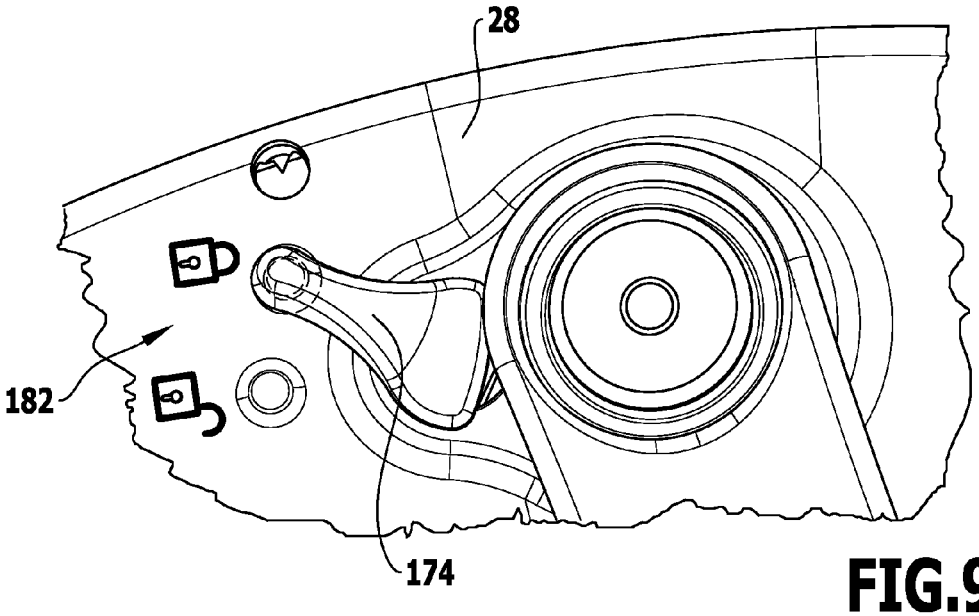
FIG. 9(*a*) shows the same view as in FIG. 8(*a*) with securing of a corresponding rotational position.
Figure 9B:
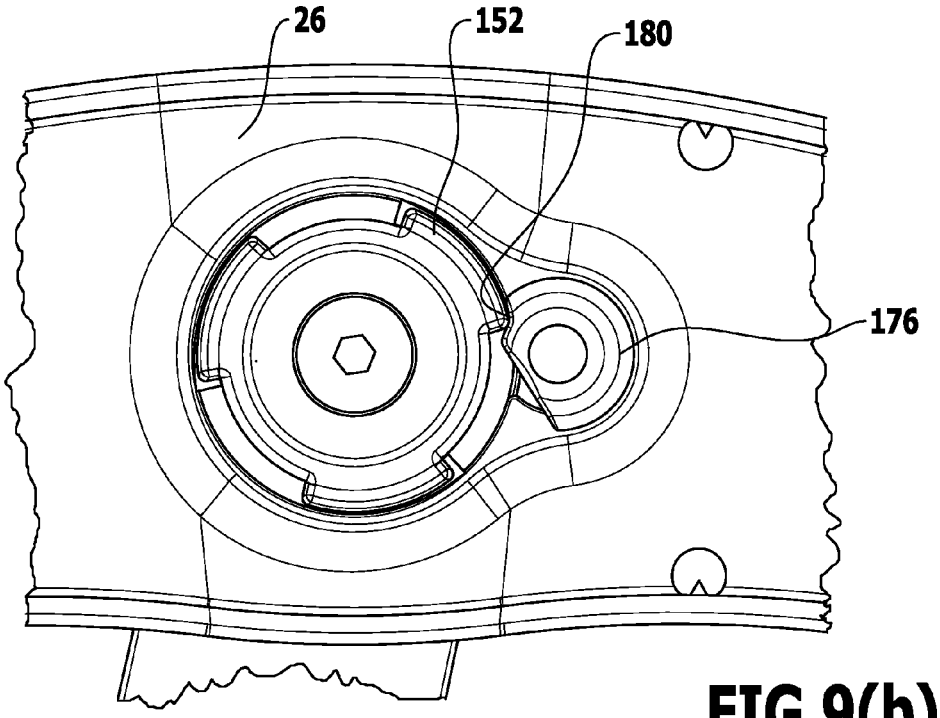

In a blocking position 182 (FIG. 9(*a*)) the actuating element 174 and therefore also the blocking head 176 are rotated relative to the release position 178 (FIG. 9(*a*) and (*b*)). The blocking face 180 of the blocking head 176 then abuts the end of a wall 152. As a result, the fixing element 126 is blocked from being removed by rotation. The anti-rotation device 162 with a rotatable element 174 with the blocking head 176 is configured here in such a way that by rotating the arm 22 relative to the holding plate 24, the rotatable element 164, proceeding from the blocking position 182, cannot be rotated, in other words the blocking position 182 cannot be overridden. To override the blocking position, it is necessary to rotate the rotatable element 164 to guide out the blocking face 180.

If the rotatable element 164 is rotated into its release position 178, the fixing element 126 can be rotated out from the corresponding groove 150 by removing the strips 84*a*, 84*b*, 84*c* and then lifted off.

One part of the first joint device 116 is the fixing element 126. Thus the position of the arm 22 with respect to the holding device 18 can be fixably adjusted (by the fixing device 142) by means of the first joint device 116 and furthermore, a releasable connection between the arm 22 and the holding device 18 can be produced. A relative position adjusted by means of the first joint device 116 between the arm 22 and the holding device 18 is not affected here by the releasable fixing between the arm 22 and the holding device 18; a relative pivoting position between the holding device 18 and the arm 22 is maintained by the rigid adjustment of the relative position of the joint body 124 with respect to the joint socket 122 because of the fixing device 142. On the one hand, this produces extensive adaptation possibilities for a musician to adjust the shoulder support 16 to his individual requirements and, on the other hand, the shoulder support 16 can be disassembled for transport. Thus, for example, the holding device 18 can remain on the musical instrument, which is accommodated, for example, in a transporting case. The arm 22 with the shoulder abutment element 20 can be released from the holding device 18, in order to be able to transport it separately.

The first joint device 116 is to a substantial extent arranged on the lower side 110 of the arm 22. The second joint device 120 is arranged, at least to a substantial extent, on the upper side 112 of the arm 22. The second joint device 122 has a joint body 184, which is spherically convex. This joint body 184 is, in particular, formed in one piece on the arm 22 in the region of the end 118. Furthermore, the second joint device 120 has a fixing element 186 associated with the joint body 184. This fixing element 186 has a joint socket 188, which has a spherically concave shape. The joint body 184 and the joint socket 188 are matched to one another and the joint body 184 is guided in a sliding manner in the joint socket 188.

The fixing element 186 is held in a captive manner on the joint body 184 and therefore on the arm 22 by means of a clamping device 190. The clamping device 190 is configured here, for example, like the clamping device 142. In particular, it is configured as a fixing device, by means of which a specific relative position between the joint body 184 and the joint socket 188 can be secured by clamping.

The clamping device 190 preferably comprises a screw 128' corresponding to the screw 128 and a nut 134' corresponding to the nut 134. The nut 134' is supported here on the arm 22, specifically on a rear side of the joint body 184.

An abutment head 130' of the screw 128' is supported on a rear side of the fixing element 186 remote from the joint socket 188.

The fixing element 186 can be inserted in the opening 104 of the shoulder abutment element 20. The opening 104 forms a fitting for the fixing element 186. It has a connecting region 192, in this case, which is basically configured the same as the connecting region 144. An anti-lifting mechanism is provided corresponding to the anti-lifting mechanism 158; by means of a relative rotation of the shoulder abutment element 20 with respect to the fixing element 186, an axial anti-lifting mechanism can be provided. Furthermore, an anti-rotation device is provided corresponding to the anti-rotation device 162, which comprises a rotatable element 164' corresponding to the rotatable element 164. For this purpose, an opening 166', in which the rotatable element 164' is inserted, is arranged on the pad holder 86 adjacent to the opening 104.

A corresponding actuating element 174' of the rotatable element 164' is seated here on the lower side 100 of the pad holder 86.

The arm 22 with the first joint device 116 and the second joint device 120 is preferably produced from a plastics material. It may be provided here that the elements provided with a thread (the screws 128, 128' and the nuts 134, 134') are produced from a metallic material.

The shoulder support 16 functions as follows:

The shoulder support 16 has three parts that can be released from one another, namely the holding device 18, the arm 22 and the shoulder abutment element 20. Optionally, the clamping elements 40*a*, 40*b* in the element 70 can also be releasable from the holding device 18.

A relative pivoting position between the arm 22 and the holding device 18 can be fixably adjusted. The height of the second end 18 relative to the holding device 18 can, in particular, be adjusted thereby in accordance with the requirements of the musician. An adjustment once selected can be "permanently" secured by the clamping device 142.

Accordingly, a relative position between the shoulder abutment element 20 and the arm 22 can be adjusted by the second joint device 120 and this adjustment can be permanently secured.

The shoulder support 16 can be disassembled into the parts mentioned for a user. The arm 22 is releasable from the holding device 18 and the shoulder abutment element 20 can be released from the arm 22.

It may basically be provided here that only the first joint device 116 or only the second joint device 120 is provided. However, this only produces lower adaptation possibilities.

It is furthermore basically possible for the arm 22, for example, to be rigidly connected to the shoulder abutment element 20, without a release function being realized.

If both the first joint device 116 and the second joint device 120 are provided, extensive adjustment possibilities are produced. If the arm 22 is releasable both from the holding device 18 and also from the shoulder abutment element 20, the shoulder support 16 can be transported in a space-saving manner, the holding device 18 being able to remain, in particular, on the musical instrument.

If a musician inserts the arm 22 by means of the fixing element 126 on the opening 82 of the holding device 18, the anti-lifting mechanism is achieved by a corresponding rotation. The corresponding rotational position is secured by means of the anti-rotation device 162. The same also applies to the fixing of the shoulder abutment element 20 on the arm 22.

A shoulder support is provided by the solution according to the invention which on the one hand comprises extensive adjustment possibilities for a musician for optimal individual adaptation. On the other hand, the arm 22 and the shoulder abutment element 20 can be released separately or in combination from the holding device 18 in order to allow easy transportation. In particular, the holding device 18 can also remain on the musical instrument during transportation of the musical instrument.

The arm 22 can be inserted from above into the opening 82. This produces an easy assembly or disassembly of the arm 22 and the holding device 18, scratches or the like on the musical instrument thereby being substantially avoided, for example.

Large parts of the shoulder support 16, and, in particular, the holding device 18 and the arm 22 can be produced from a plastics material. This allows the shoulder support 16 to be produced with a small mass. As a result, the sound of the musical instrument is minimally influenced.

Figure 10A:
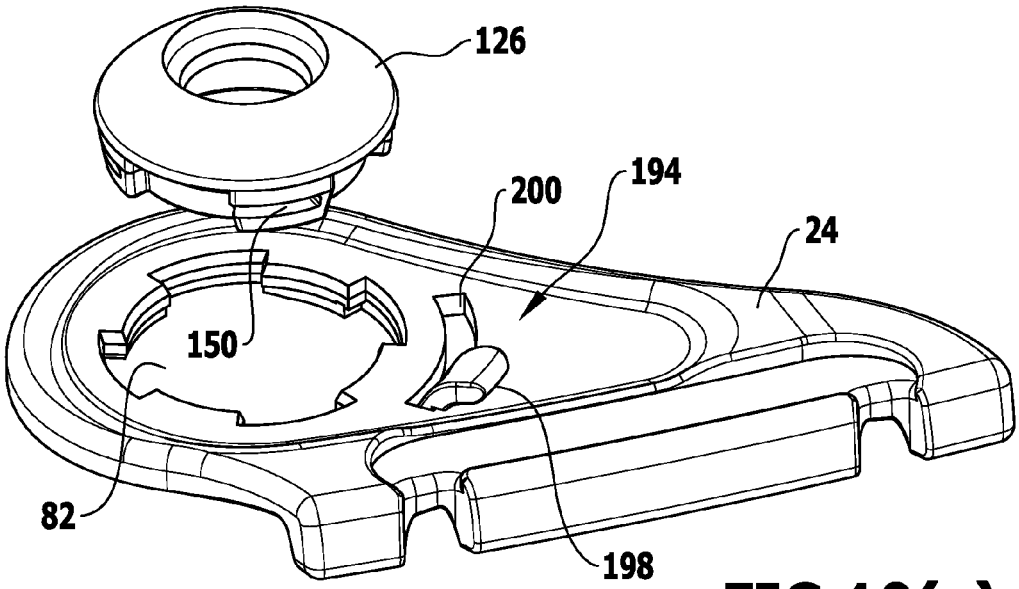
FIG. 10(*a*) shows a partial view of a further embodiment of an anti-rotation device in a position, in which an insertion is allowed.
Figure 10B:
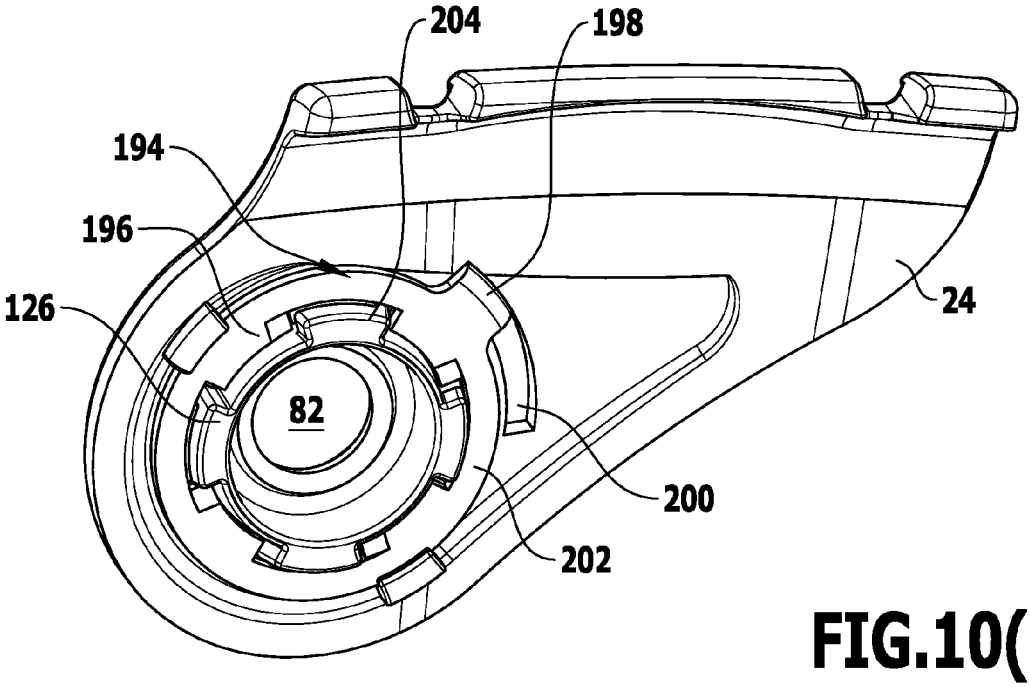

In one embodiment of an anti-rotation device, which is shown schematically in FIGS. 10(*a*) to 11(*b*) and designated 194 there, an annular element is provided as a rotatable element 196. This annular element 196 has a lug 198. The rotatable element 196 is arranged on one side, for example of the holding plate 24. A slot 200 is formed in the holding plate 24. The lug 198 is inserted through this slot 200, so an actuation of the annular element 196 is possible from the other side, for example of the holding plate 24.

The annular element 202 of the rotatable element 196 has spaced-apart strips 204. A corresponding strip 204 can be positioned in front of one end 156 of a groove 150 to provide an anti-rotation device.

Figure 11A:
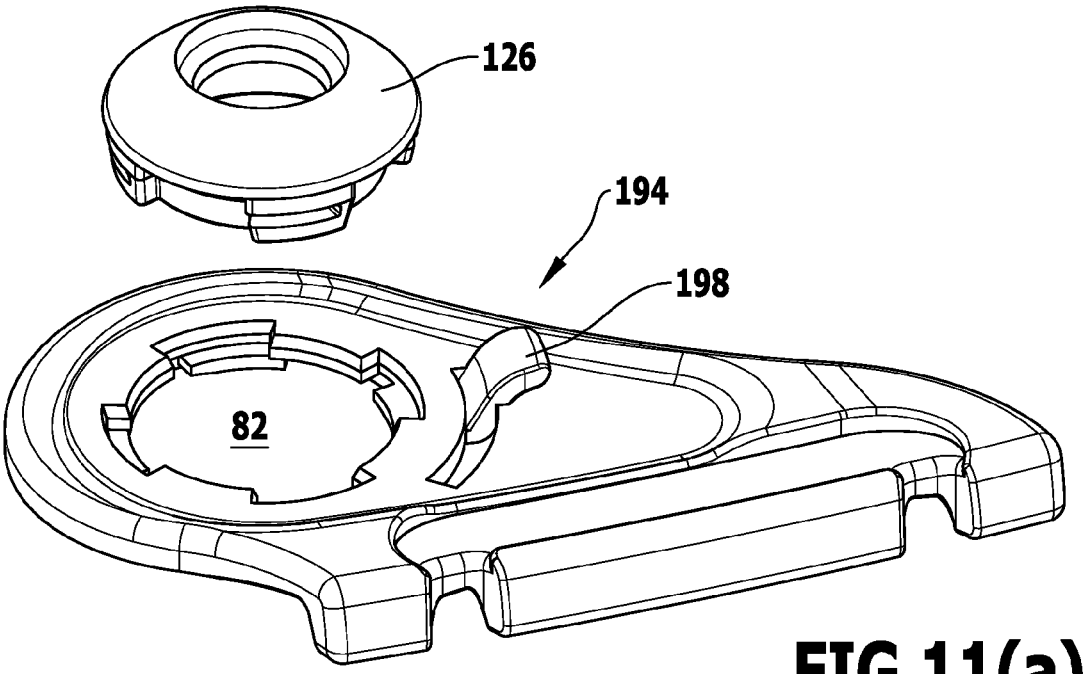
FIG. 11(*a*) shows the same view as FIG. 10(*a*) in a blocking position of the anti-rotation device.
Figure 11B:
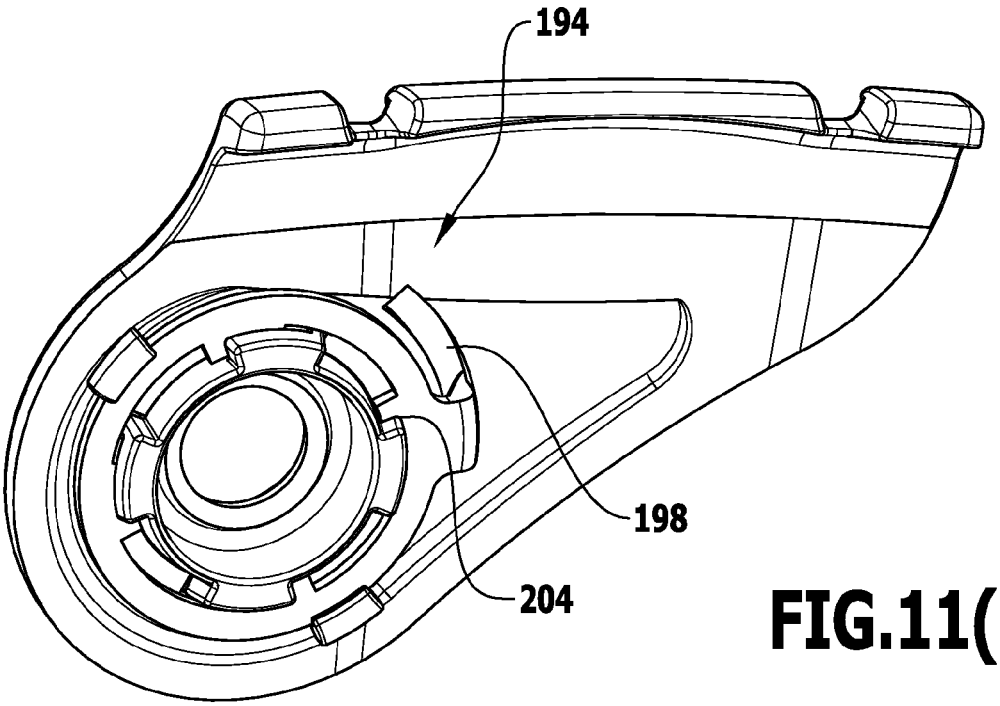

FIGS. 10(*a*) and (*b*) show a release position, in which the fixing element 126 can be inserted in the opening 82. A blocking position 182, in which strips 204 block a removal of strips 84*a*, 84*b*, 84*c* from the grooves 150, is shown in FIGS. 11(*a*) and (*b*). The strips 204 may also be partially inserted here in the grooves 150.

A corresponding solution can also be used for the anti-rotational fixing of the shoulder abutment element 20 on the arm 22.

Figure 12A:
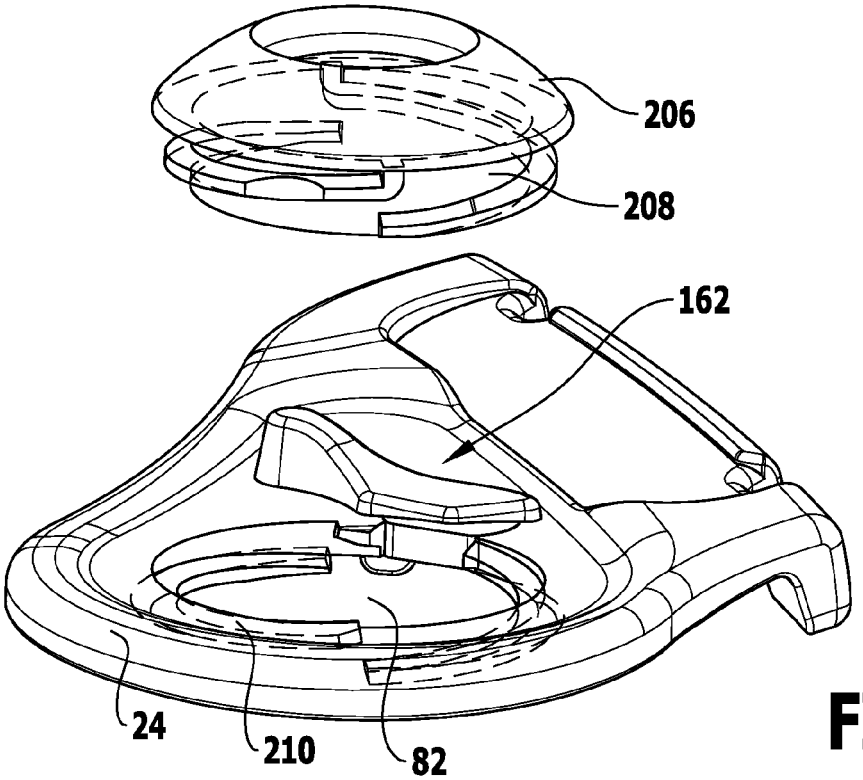
FIG. 12(*a*) shows a view of a further embodiment of an anti-rotation device.
Figure 12B:
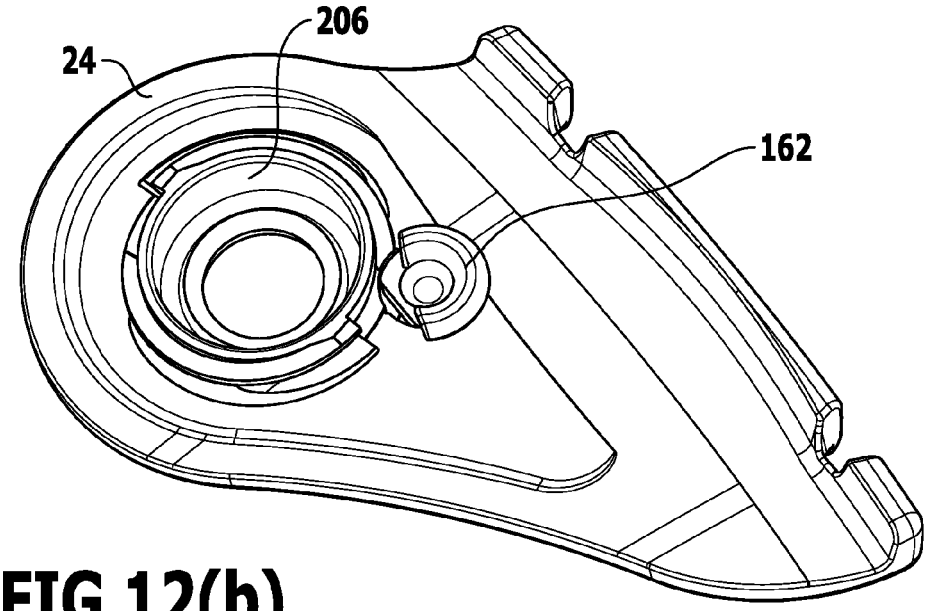

In a further embodiment, which is shown schematically in FIGS. 12(*a*) and (*b*), a fixing element 206 is provided, which has a helical groove path 208, in which a helically designed strip 210 can enter at the opening 82. As a result, an anti-lift mechanism can be realized. A fixing position relative to rotation is secured by means of a corresponding anti-rotation device 182.

Figure 13:
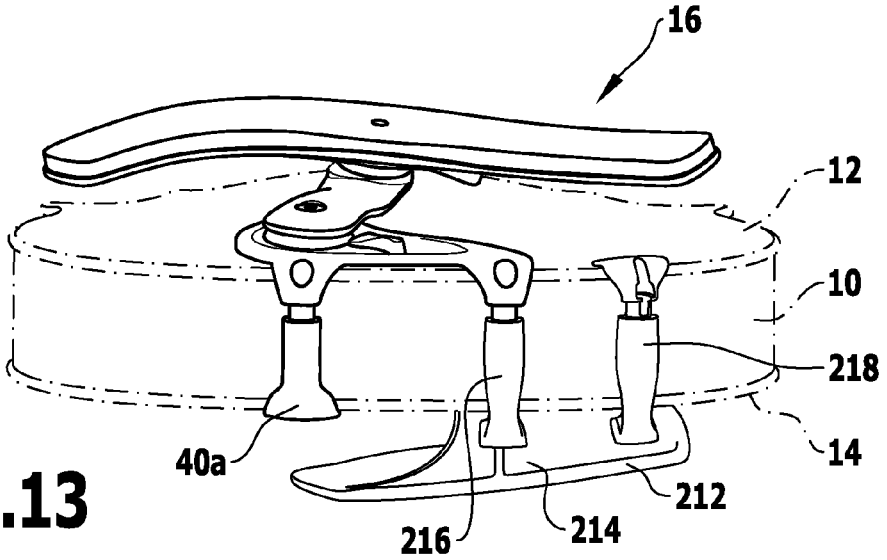
FIG. 13 shows an embodiment of a shoulder support, which is fixed on a musical instrument, the shoulder support having a chin holder.
Figure 14:
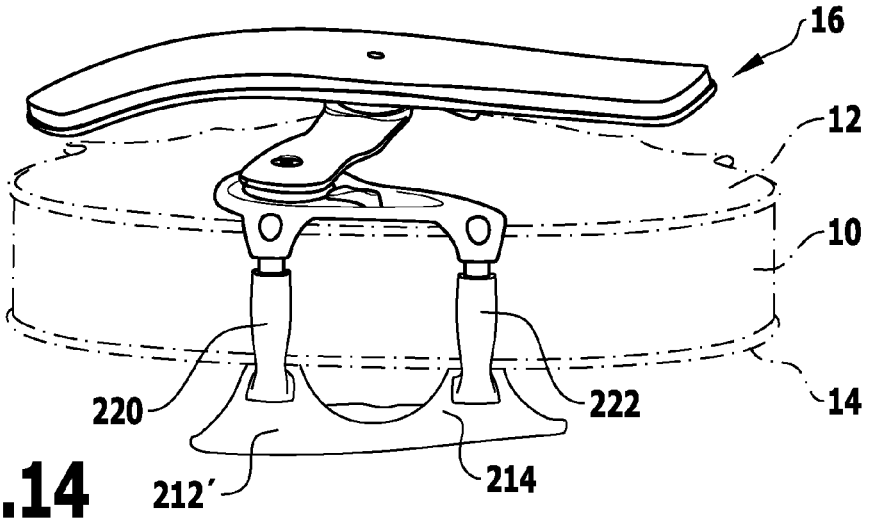
FIG. 14 shows a further embodiment of a shoulder support with a chin holder.
Figure 15:
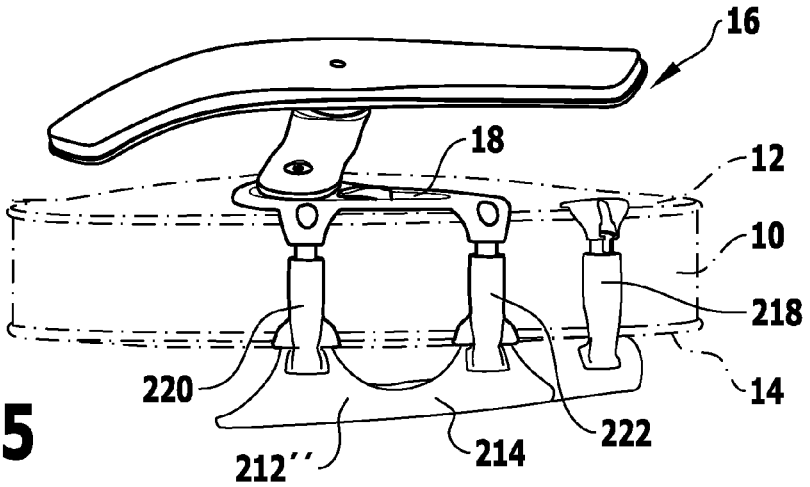
FIG. 15 shows a further embodiment of a shoulder support with a chin holder.
Figure 16:
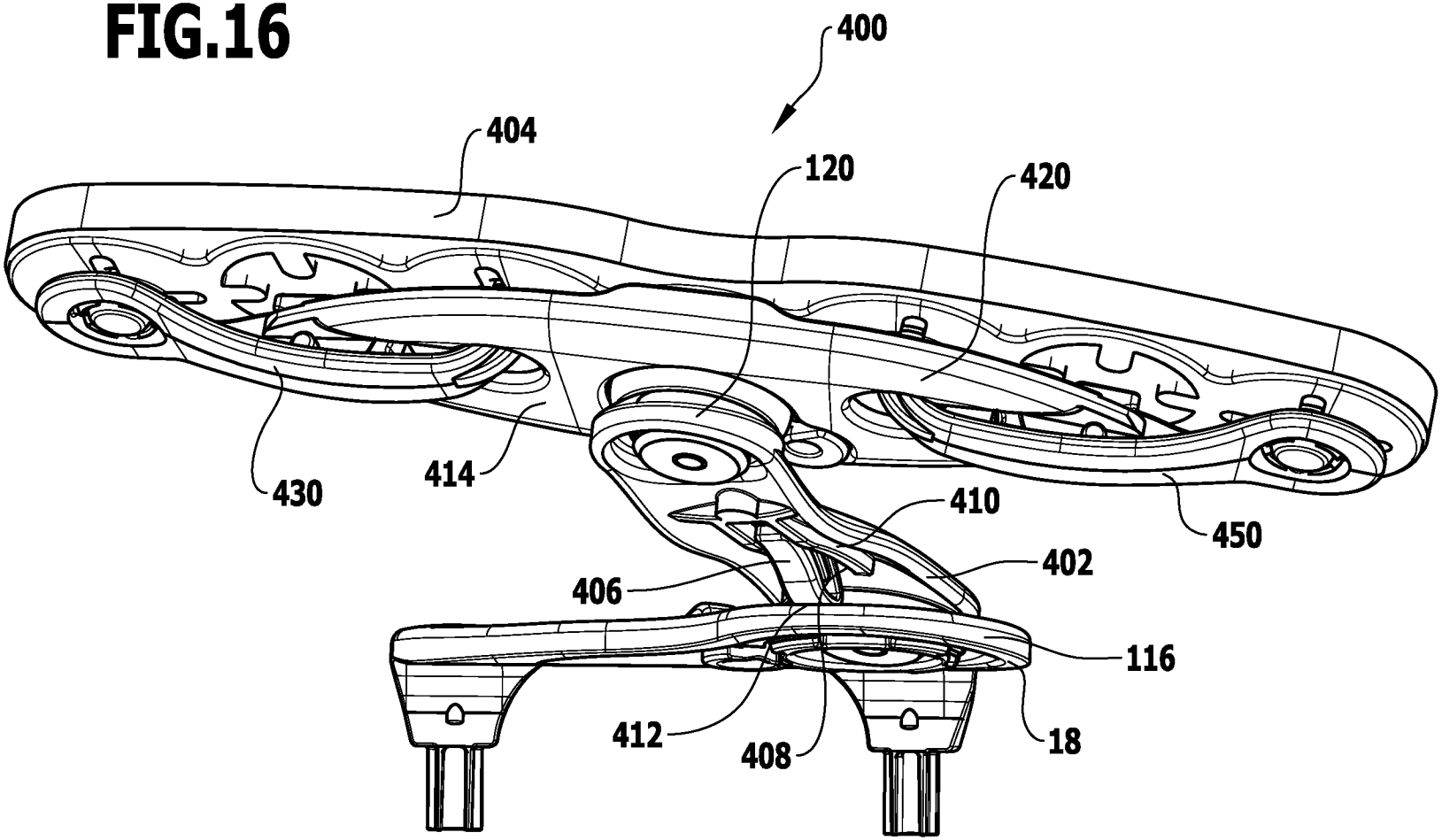
FIG. 16 shows a perspective view of an embodiment of a shoulder support according to the invention.
Figure 17:
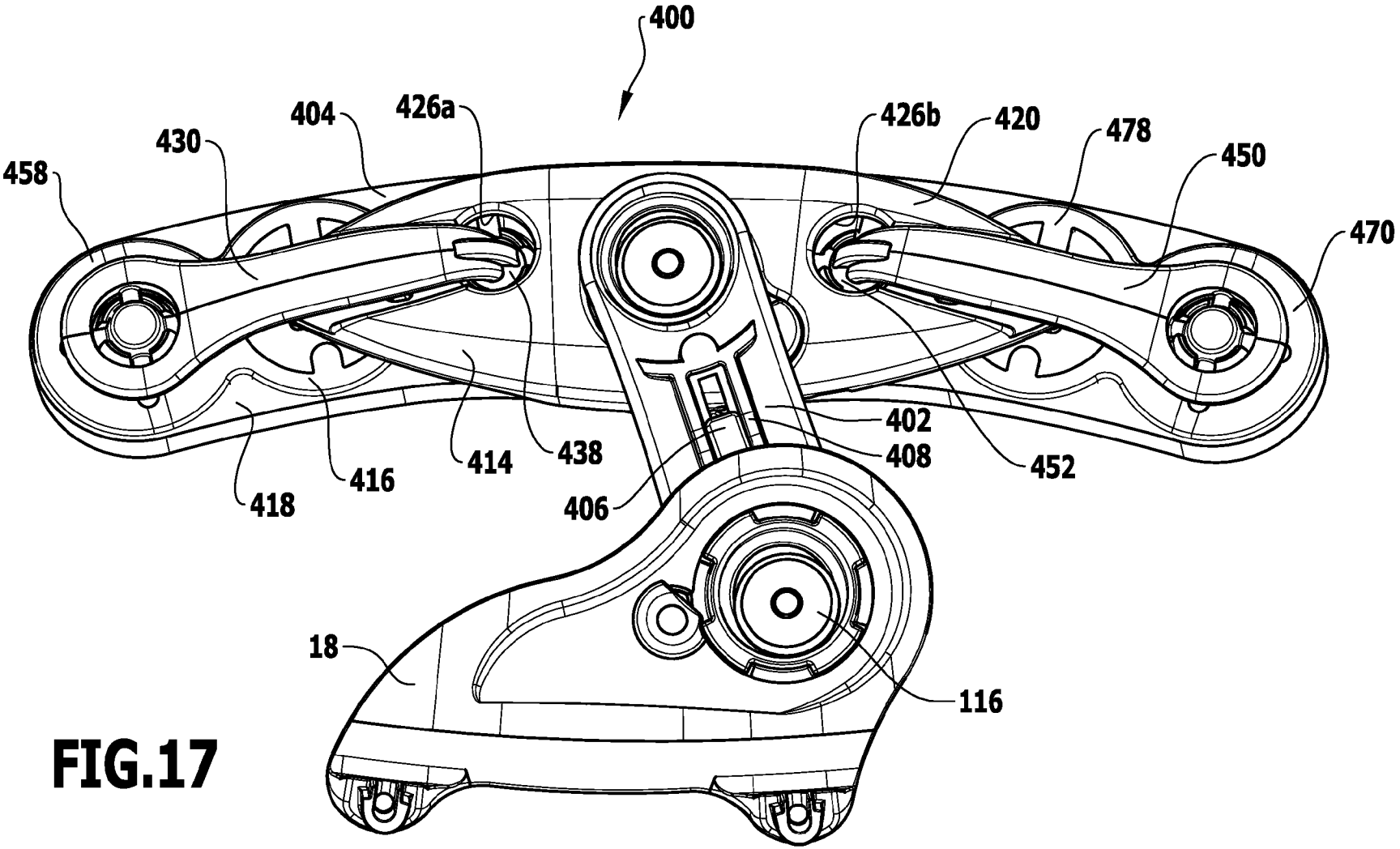
FIG. 17 shows the shoulder support according to FIG. 16 from a lower side.
Figure 18:
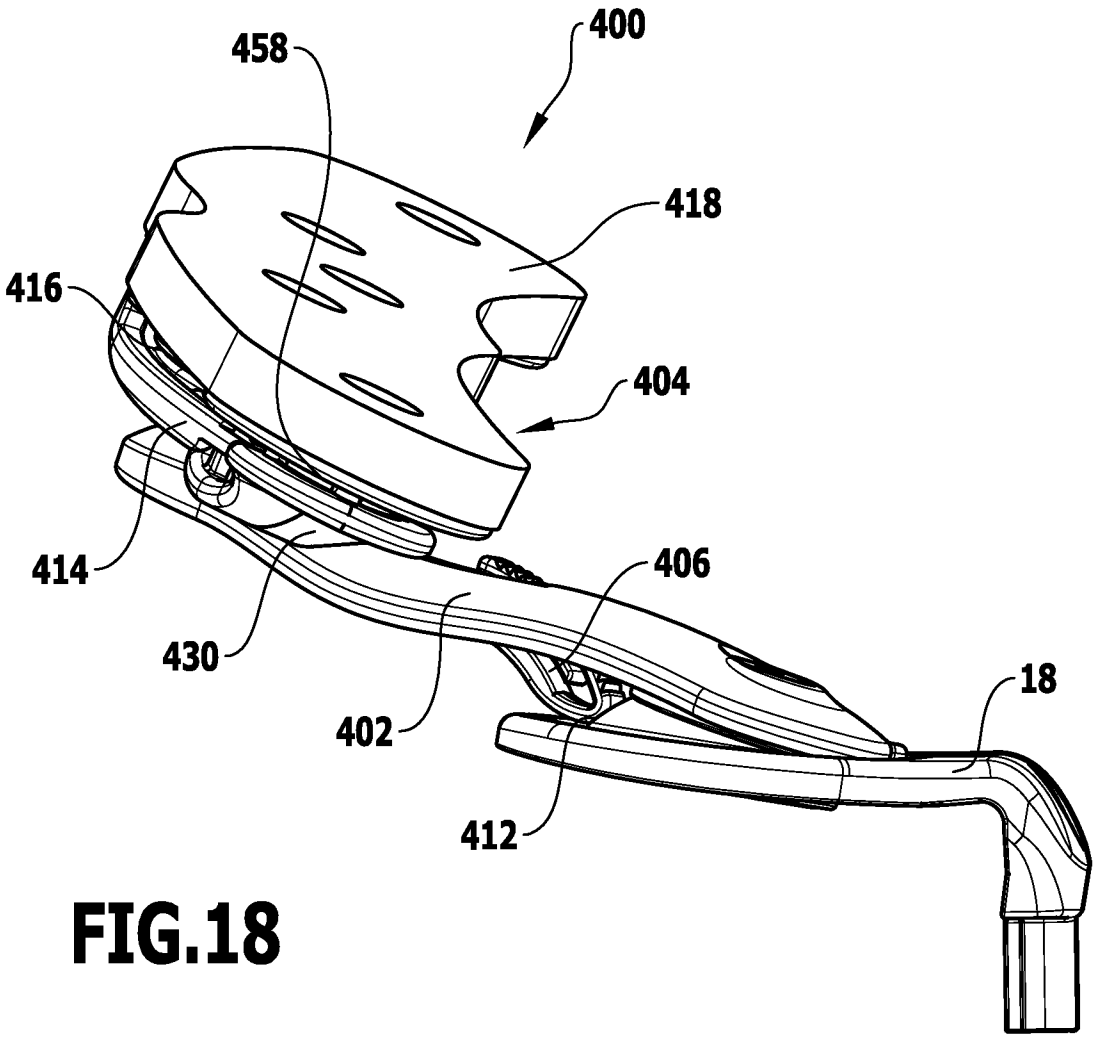
FIG. 18 shows a side view of the shoulder support according to FIG. 16.
Figure 19:
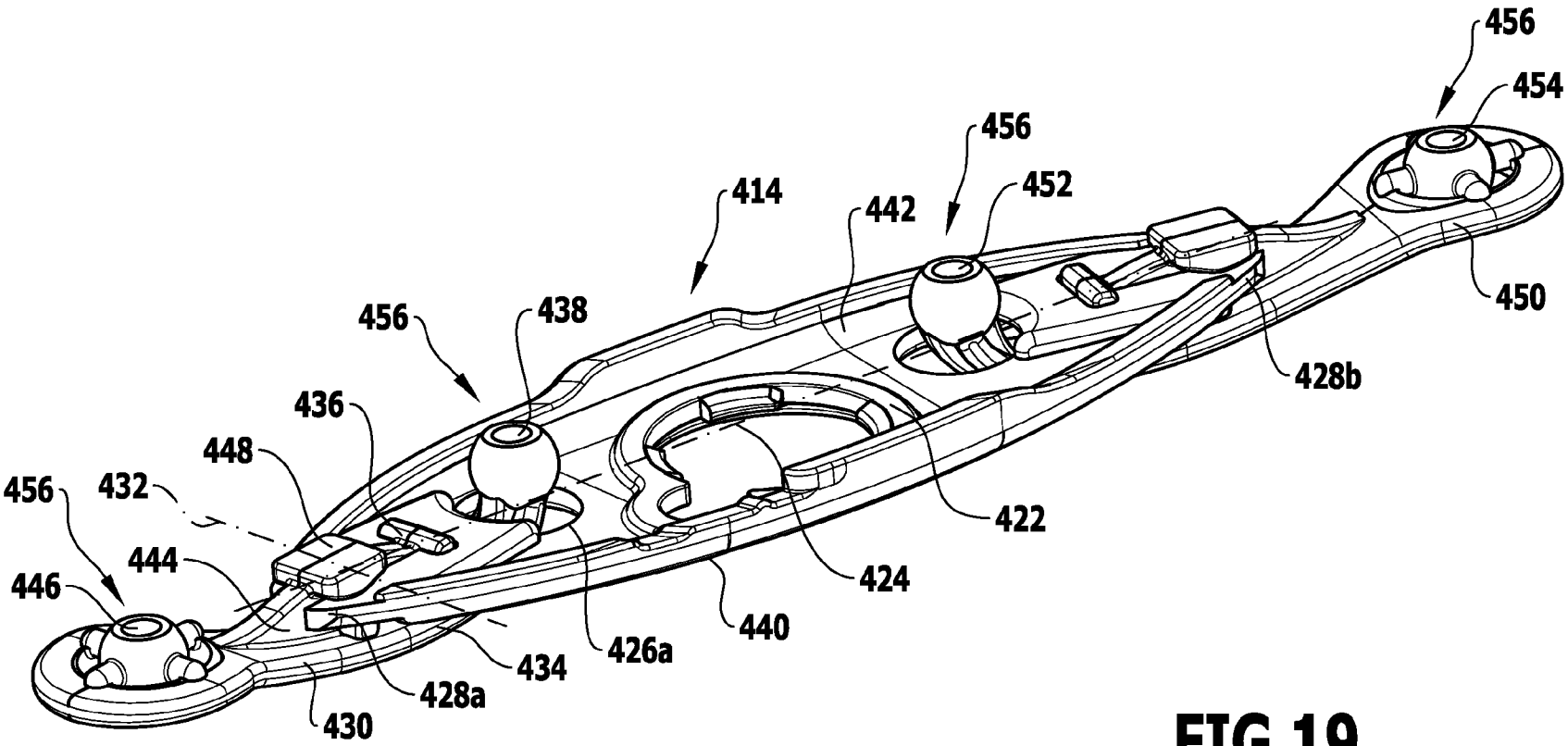
FIG. 19 shows an arm connecting part of the shoulder support according to FIG. 16.
Figure 20:
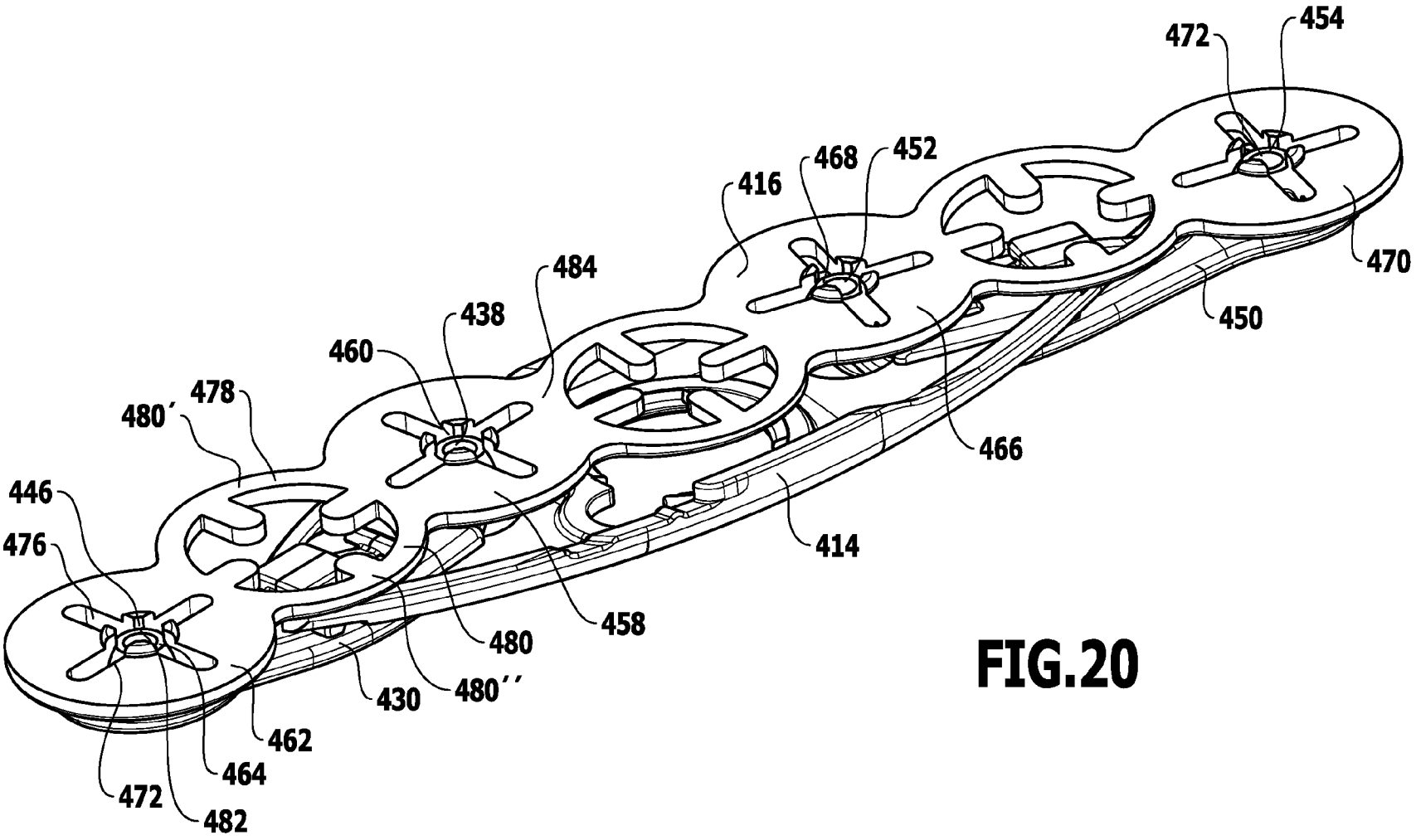
FIG. 20 shows the arm connecting part according to FIG. 19, with a pad holder fixed thereon.
Figure 21:
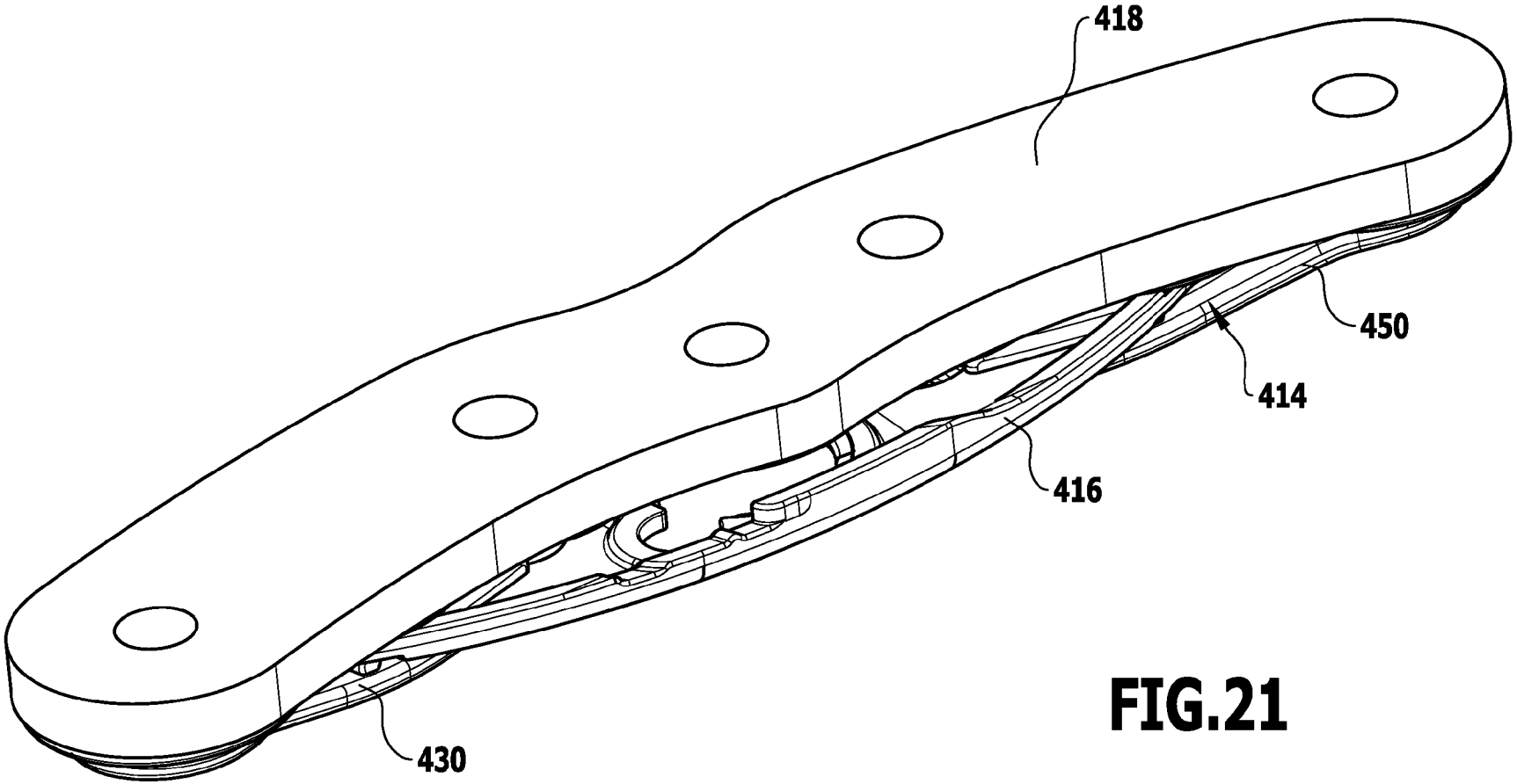
FIG. 21 shows the combination of the arm connecting part and pad holder according to FIG. 20 with a pad fixed on the pad holder.
Figure 22:
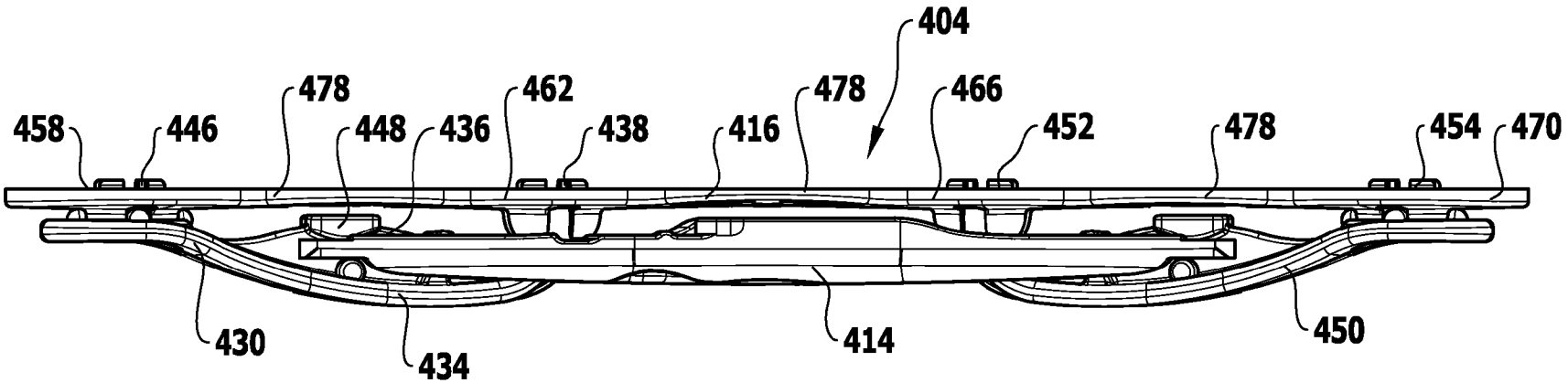
FIG. 22 shows a side view of the combination of the arm connecting part and pad holder according to FIG. 19.

It is also possible, as indicated in FIGS. 13 to 15, for a chin holder 212 to be fixed on the musical instrument by means of the holding device 18. In particular, the sound box 10 of the musical instrument is then clamped between a chin support 214 of the chin holder 212 and the holding device 18. The chin support 214 faces the top 14 of the musical instrument, in this case. In one embodiment, which is shown schematically in FIG. 13, the holding device 18 is clamped on the sound box 10 by means of a clamping element corresponding to the clamping element 40*a*. Furthermore, the holding device is fixed on the sound box 10 by means of a clamping element 216 of the chin holder 212. The chin holder 214 is fixed to the sound box by means of a further clamping element 218, independently of the holding device 18.

In the embodiment shown in FIG. 14, the corresponding chin holder 212' is seated by means of corresponding clamping elements 220, 222 directly on the holding device 18. A corresponding chin support 214 of the chin holder 212' and the holding device 18 then form clamping elements, which ensure the clamping on the sound box 10.

In the embodiment shown in FIG. 15, the chin holder 212" is held on the holding device 18 by means of clamping elements 220, 222 and by means of an additional clamping element corresponding to the clamping element 218 is again clamped with the sound box 10.

It is advantageous for the clamping elements, which engage on the chin holder 212, 212', 212" here if a solution is provided as described in EP 1 067 508 A2, to which reference is expressly made. A corresponding chin support 214 has an insertion guide for a clamping element and the insertion guide is arranged and formed in such a way that the insertion direction is oblique with respect to the clamping direction. As a result, a clamping element can be realized, which has no metallic parts on a side which can come into contact with the skin of the musician. Reference is made to EP 1 067 508 A2.

An embodiment of a shoulder support according to the invention, which is shown in FIGS. 16 to 22 and designated 400 there, comprises a holding device, which is basically configured the same as the holding device 18 described above. The same reference numerals are used for the same elements. An arm 402 is held by means of a joint device corresponding to the first joint device 116 on the holding device 18. A shoulder abutment element 404 is held on the aim 402 by means of a second joint device corresponding to the second joint device 120.

An adjustment element 406 is arranged on the arm 402. For this purpose, a corresponding guide 408 is formed on the arm 402. The guide 408 is, in particular, formed by means of a recess 410 in the arm 402. The recess 410 and therefore the guide 408 is curved accordingly.

The adjustment element 406 is displaceable, and in particular linearly displaceable, in the guide 408. A corresponding displacement position in the guide 408 is fixed by a force-locking connection.

The adjustment element 406 has an abutment region 412 for the holding device 18. The abutment region 412 projects beyond the arm 402 in the direction of the abutment element 18. The abutment region 412 can contact the holding device 18. The sliding position of the adjustment element 406 of the guide 408 determines at what height the abutment region 412 projects beyond the arm 402.

A setting angle of the arm 402 relative to the holding device 18 can be "marked" by a corresponding positioning of the adjustment element 406 of the guide 408. If the shoulder support 400 is disassembled into the arm 402, shoulder abutment element 404 and holding device 18, then during assembly, a setting angle marked a single time by means of the positioning of the adjustment element 406 between the arm 402 and the holding device 18 can then be reached quickly and easily when assembling the shoulder support 400.

The adjustment element 406 is a type of latch, by means of which the setting angle between the arm 402 and holding device 18 can be preselected.

In particular, the adjustment element 406 and the guide 408 are configured in such a way that the height of a pad over a musical instrument is independent of the setting angle between the arm and the holding device 18.

The shoulder abutment element 404 comprises an arm connecting part 414, a pad holder 416, which is held on the arm connecting part 414, and a pad 418, which is in turn held on the pad holder 416.

The arm connecting part 414 comprises a center part 420, which is connected in an articulated and releasable manner by means of the second joint device 120 to the arm 402. For this purpose, a corresponding joint socket 422 is formed in the center part 420. The center part 420 has a direction of extent 424. A first continuous recess **426*a* is formed on one side of the joint socket 422 with respect to the direction of extent 424. A second continuous recess 426*b* is formed on the second side (in the direction of extent 424**) opposite this first side.

The center part 420 has a first end **428*a* and an opposite second end 428*b*** in the direction of extent.

A first rocker 430 is seated on the center part 422 in the region of the first end **428*a*. This rocker 430 is movably held on the center part 420 and pivotable, at least approximately, about an axis 432, which is located transversely and, in particular, perpendicular, to the direction of extent 424. The first rocker 430 has a first tongue 434 and a second tongue 436. The first tongue 434 and the second tongue 436 are spaced apart with an intermediate space. The first rocker 430 is pushed by way of this intermediate space onto the center part 420 in the region of the first end 428*a***.

A first joint head 438 sits on the first tongue. The joint head projects transversely to a corresponding surface of the first tongue 434 and is inserted through the first recess **426*a*, The center part 420 has a lower side 440 facing the holding device 18 and an upper side 442 facing the pad 418. The first tongue 434 faces the lower side 440 and, in particular, is positioned touching it. The first joint head 438 projects through the recess 426 and out of the upper side 442. The second tongue 436 is positioned on the upper side 442** and touches it, in particular.

The first tongue 434 and the second tongue 436 are held on a common holder 444 of the rocker 430 and, in particular, held in one piece. The holder 444 is located here in front of the first end **428*a***.

A second joint head 446 is arranged on the holder 444 in turn spaced apart from the first joint head 438.

The first rocker 430 is, in particular, formed in one piece. An abutment element 448 is formed on the second tongue 436 and abuts the upper side 442 allowing a movable and, in particular, pivotable mounting about the axis 432.

A second rocker 450, which is basically configured the same as the first rocker 430, is arranged on the center part 420 in the region of the second end 428. The second rocker 450 comprises a third joint head 452, which is the counterpart to the first joint head 438, and furthermore comprises a fourth joint head 454 as the counterpart to the second joint head 446.

A pad holder joint device 456 is formed by means of the joint heads 438, 446, 452, 454.

The joint heads 438, 446, 452, 454 are, in particular, formed as ball heads.

The pad holder 416 is movably held on the arm connecting part 414 by means of the pad holder joint device 456. The pad holder 416 for this purpose comprises a first receiving element 458 with a first seating 460 (joint socket) for the first joint head 438. The pad holder 416 furthermore comprises a second receiving element 462 with a second seating 464 for the second joint head 446. It furthermore comprises a third receiving element 466 with a third seating 468. Furthermore, it has a fourth receiving element 470 with a fourth seating 472. The third seating 468 is used to receive the third joint head 452 and the fourth seating 472 is used to receive the fourth joint head 454.

In one embodiment, the receiving elements 458, 462, 466, 470 are formed by circular discs. Receivers 460 etc. in the respective receiving element 458 etc, are formed by a corresponding recess 474 with a spherical surface. The recess 474 is located, for example, in the crossing region of slots 476.

Adjacent receiving elements (the receiving elements 458 and 462, the receiving elements 462 and 466, the receiving elements 466 and 470) are connected to one another by a respective web member 478. The web member 478 in this case comprises at least one web 480, which connects the adjacent receiving elements (for example 458 and 462), a web having a smaller width than the corresponding receiving elements (for example 458 and 462). The web member 478 allows a (settable) movability of adjacent receiving elements (for example 458 and 462), so individual positions are settably adjustable on the respective joints (which are formed by the joint heads and the associated seatings) on the respective receiving elements 458, and the corresponding web member 478 allows the adjustment and fixing of a respective individual position.

In the embodiment shown, the web member 478 is itself circular and comprises arcuate web elements 480' and 480".

The pad holder 416 with the receiving elements 458, 462, 466, 470 is, in particular, formed in one piece. The web elements 480' and 480" are spaced apart from one another. They, in particular, at least approximately, have the same height as the corresponding recesses 458 etc.

The pad 418 is fixed to the pad holder 416. In one embodiment, the corresponding joint heads 438 etc. are provided with fastening points 482, such as, for example, threaded recesses, into which a fastening element such as a screw can in each case be inserted and fixed, the pad 418 being fixable by means of the fastening point. In one embodiment, the pad holder 416 is thereby also fixed to the joint heads 438 etc. and therefore to the arm connecting part 416.

The pad holder 416 forms a flexible pad seating for the pad 418 and owing to the movable mounting of the rockers 430 and 450 and owing to the pad holder joint device 456, a pad receiving face 484, on which the pad 418 abuts, can be brought into a defined shape, which, in particular, is adapted to body contours of a musician. The pressure correspondingly exerted on the pad 418 can be distributed over the entire area. The pad 418 cannot escape to one side and a support function is retained.

The pad 418 itself, because of the mounting by the pad holder joint device 456 and the rockers 430, 450, is intrinsically twistable and tiltable.

Otherwise, the shoulder support 400 functions as described above, for example with reference to the shoulder support 16.

LIST OF REFERENCE NUMERALS

10 sound box
12 base
14 top
16 shoulder support
18 holding device
20 shoulder abutment element
22 arm
24 holding plate
26 lower side
28 upper side
30*a* first flange
30*b* second flange
32 guide channel
34 screw
36 mouth
38 screw head
40*a* first clamping element
40*b* second clamping element
42 foot
44 pad
46 counter-element
48 internal thread
50 external thread
52 element
54 abutment region
56 element
58 receiving region
60 axis
62 abutment region
64 clamping direction
66 pad
68 bridge
70 element
72 recess
74 web
76 undercut region
78*a* opening
78*b* opening
80 limiting face
82 opening
84*a* strip
84*b* strip
84*c* strip
86 pad holder
88 pad
90 first limiting contour
92 second limiting contour
94 receiving space
96 base element
98 edge wall
100 lower side
102 upper side
104 opening
106 strip
108 recess
110 lower side
112 upper side
114 first end
116 first joint device
118 second end
120 second joint device
122 joint socket
124 joint body
126 fixing element
128, 128' screw
130, 130' abutment head
132 opening
134, 134' nut
136, 136' abutment head
138 flange
140 opening
142 clamping device/fixing device
144 connecting region
146 annular element
148 abutment face
150 groove
152 wall
154 end
156 end
158 anti-lifting mechanism
160 stop
162 anti-rotation device

164, 164' rotatable element
166, 166' opening
168 shaft
170*a* elements
170*b* elements
172 rotational axis
174, 174' actuating element
176 blocking head
178 release position
180 blocking face
182 blocking position
184 joint body
186 fixing element
188 joint socket
190 clamping device/fixing device
192 connecting region
194 anti-rotation device
196 rotatable element
198 lug
200 slot
202 annular element
204 strip
206 fixing element
208 groove path
210 strip
212, 212', 212" chin holder
214 chin support
216 clamping element
218 clamping element
220 clamping element
222 clamping element
400 shoulder support
402 arm
404 shoulder abutment element
406 adjustment element
408 guide
410 recess
412 abutment region
414 arm connecting part
416 pad holder
418 pad
420 center part
422 joint socket
424 direction of extent
426*a* first recess
426*b* second recess
428*a* first end
428*b* second end
430 first rocker
432 axis
434 first tongue
436 second tongue
438 first joint head
440 lower side
442 upper side
444 holder
446 second joint head
448 abutment element
450 second rocker
452 third joint head
454 fourth joint head
456 pad holder joint device
458 first receiving element
460 first seating
462 second receiving element
464 second seating
466 third receiving element
468 third seating
470 fourth receiving element
472 fourth seating
474 recess
476 slot
478 web member
480 web element
480', 480" web element
482 fastening points
484 pad receiving face

The invention claimed is:

1. A shoulder support for a musical instrument, comprising:

a holding device, by means of which the shoulder support is fixable or fixed to the musical instrument;

at least one arm, which is fixable or fixed to the holding device; and a shoulder abutment element, which is fixable or fixed to the at least one arm and has a pad and a pad holder;

wherein the pad holder is movably held on an arm connecting part of the shoulder abutment element by means of a pad holder joint device; and wherein fastening points to fix the pad to the pad holder are formed on joint heads of the pad holder joint device.

2. The shoulder support according to claim 1, wherein the pad holder joint device has at least three spaced-apart joints.

3. The shoulder support according to claim 2, wherein a second joint device is arranged between at least one joint on one side and at least two spaced-apart joints arranged on an opposite side.

4. The shoulder support according to claim 1, wherein the pad holder joint device comprises ball-and-socket joints.

5. The shoulder support according to claim 1, wherein a first rocker element and a second rocker element are arranged on the arm connecting part.

6. The shoulder support according to claim 5, wherein at least some of the joint heads of the pad holder joint device are formed on the first rocker element and the second rocker element.

7. The shoulder support according to claim 1, wherein the pad holder comprises receiving elements with respective receivers for joint heads of the pad holder joint device, adjacent receiving elements being connected by at least one web and adjacent receiving elements being movable relative to one another by the at least one web.

8. The shoulder support according to claim 1, wherein at least one of (i) the at least one arm is held on the holding device by means of a first joint device associated with a first fixing device, by means of which a relative position between the at least one arm and the holding device is settable, and (ii) the shoulder abutment element is held on the at least one arm by means of a second joint device associated with a second fixing device, by means of which a relative position between the shoulder abutment element and the at least one arm is settable.

9. The shoulder support according to claim 8, wherein at least one of (i) a part of the first joint device is configured as a fixing element for fixing of the at least one arm to the holding device and (ii) a part of the second joint device is configured as a fixing element for fixing of the shoulder abutment element to the at least one arm.

10. The shoulder support according to claim 8, wherein at least one of the first joint device and the second joint device is configured as a ball-and-socket joint device.

11. The shoulder support according to claim 8, wherein at least one of the first joint device and the second joint device comprises a joint socket and a joint body, which is movable in the joint socket.

12. The shoulder support according to claim 11, wherein the joint socket has a concave spherical shape and the joint body has a convex spherical design.

13. The shoulder support according to claim 11, wherein the joint socket is arranged on a first device and the joint body is arranged on a second device.

14. The shoulder support according to claim 11, wherein at least one of the first fixing device and the second fixing device is configured as a clamping device, by means of which the joint body and the joint socket are clampable to one another.

15. The shoulder support according to claim 13, comprising a first element, which abuts on an outer side of the first device, which is opposite to the joint socket, and a second element, which abuts on an outer side of the second device, which is opposite to the joint body, the first element and the second element being connected to one another.

16. The shoulder support according to claim 15, wherein of the first element and the second element, one element is a screw with an abutment head and the other element is a nut, on which the screw is guided.

17. The shoulder support according to claim 13, wherein for the first joint device of the first device and the second device, one device is the at least one arm or the holding device and the other device is a fixing element.

18. The shoulder support according to claim 13, wherein for the second joint device of the first device and the second device, one device is the at least one arm or the shoulder abutment element and the other device is a fixing element for fixing of the shoulder abutment element to the at least one arm.

19. The shoulder support according to claim 8, wherein at least one of the first joint device and the second joint device is arranged on the at least one arm.

20. The shoulder support according to claim 19, wherein the first joint device and the second joint device are arranged on opposite sides of the at least one arm.

21. The shoulder support according to claim 1, wherein either the holding device or the at least one arm has an opening, at which a fixing element of the at least one arm or the holding device is insertable or inserted.

22. The shoulder support according to claim 1, wherein either the shoulder abutment element or the at least one arm has an opening, in which a fixing element of the at least one arm or of the shoulder abutment element is insertable or inserted.

23. The shoulder support according to claim 21, wherein the opening has an axis, which, when the holding device is fixed on a sound box of the musical instrument, is oriented at least approximately perpendicular to the sound box.

24. The shoulder support according to claim 21, wherein an anti-lifting mechanism is formed on the fixing element and the opening.

25. The shoulder support according to claim 24, wherein the anti-lifting mechanism comprises at least one strip which is insertable in a groove.

26. The shoulder support according to claim 25, wherein an insertion into the groove is achievable by a rotational movement of the fixing element relative to the opening.

27. The shoulder support according to claim 26, comprising a stop, which blocks a further rotation.

28. The shoulder support according to claim 26, comprising an anti-rotation device, by means of which a rotational position is securable.

29. The shoulder support according to claim 28, wherein the anti-rotation device comprises a pivotable or rotatable element, which is applied to the fixing element in a blocking position.

30. The shoulder support according to claim 29, wherein the pivotable or rotatable element is mounted on the holding device, on which the opening is formed.

31. The shoulder support according to claim 1, wherein at least one of the at least one arm and the holding device is produced from a plastics material.

32. The shoulder support according to claim 1, wherein there is arranged on the at least one arm an adjustment element for setting an angle of at least one of the at least one arm with respect to the holding device and the shoulder abutment element with respect to the at least one arm.

33. The shoulder support according to claim 32, wherein the at least one arm is provided with a guide for the adjustment element, wherein a position of the adjustment element in the guide predetermines a setting angle.

34. The shoulder support according to claim 33, wherein at least one of (i) the adjustment element is fixed on the at least one arm and (ii) an adjusted position of the adjustment element is fixed in the guide by a force-locking connection.

35. The shoulder support according to claim 32, wherein the adjustment element has an abutment region for contact with at least one of the holding device and the shoulder abutment element.

36. The shoulder support according to claim 1, wherein a chin holder is fixable or fixed on the holding device.

37. The shoulder support according to claim 36, wherein a chin support of the chin holder and a holding plate of the holding device form clamping elements, between which a sound box of the musical instrument is clampable, the chin support and the holding plate being connected by at least one clamping element.

38. The shoulder support according to claim 37, wherein the chin support has an insertion guide for the at least one clamping element and the insertion guide is arranged and configured in such a way that an insertion direction is oblique with respect to a clamping direction.

39. The shoulder support according to claim 31, wherein elements provided with a thread are produced from a metallic material.

40. A shoulder support for a musical instrument, comprising:

a holding device, by means of which the shoulder support is fixable or fixed to the musical instrument;

at least one arm, which is fixable or fixed to the holding device; and a shoulder abutment element, which is fixable or fixed to the at least one arm and has a pad and a pad holder;

wherein the pad holder is movably held on an arm connecting part of the shoulder abutment element by means of a pad holder joint device; and wherein the pad holder comprises receiving elements with respective receivers for joint heads of the pad holder joint device, adjacent receiving elements being connected by at least one web and adjacent receiving elements being movable relative to one another by the at least one web.

* * * * *